US010283035B2

(12) United States Patent
Kobayashi

(10) Patent No.: US 10,283,035 B2
(45) Date of Patent: May 7, 2019

(54) FIELD-SEQUENTIAL IMAGE DISPLAY DEVICE AND IMAGE DISPLAY METHOD

(71) Applicant: Sharp Kabushiki Kaisha, Sakai, Osaka (JP)

(72) Inventor: Masamitsu Kobayashi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 13 days.

(21) Appl. No.: 15/316,887

(22) PCT Filed: Jun. 1, 2015

(86) PCT No.: PCT/JP2015/065733
§ 371 (c)(1),
(2) Date: Dec. 7, 2016

(87) PCT Pub. No.: WO2016/002409
PCT Pub. Date: Jan. 7, 2016

(65) Prior Publication Data

US 2017/0098406 A1 Apr. 6, 2017

(30) Foreign Application Priority Data

Jul. 1, 2014 (JP) ..... 2014-135683

(51) Int. Cl.
*G09G 3/20* (2006.01)
*G09G 3/36* (2006.01)
(Continued)

(52) U.S. Cl.
CPC ..... *G09G 3/2022* (2013.01); *G09G 3/2003* (2013.01); *G09G 3/3413* (2013.01);
(Continued)

(58) Field of Classification Search
CPC ..... G09G 3/3413; G09G 2310/0235; G09G 2320/0247; G09G 2320/0276; G09G 2320/0686; G09G 2360/16
See application file for complete search history.

(56) References Cited

U.S. PATENT DOCUMENTS

2002/0122019 A1 9/2002 Baba et al.
2013/0293598 A1 11/2013 Ishihara

FOREIGN PATENT DOCUMENTS

JP 2002/191055 A 7/2002
JP 2002/318564 A 10/2002
(Continued)

OTHER PUBLICATIONS

International Search Report PCT/ISA/210 for International Application No. PCT/JP2015/065733 dated Sep. 1, 2015.

*Primary Examiner* — Stacy Khoo
(74) *Attorney, Agent, or Firm* — ScienBiziP, P.C.

(57) ABSTRACT

A subframe data generator 12 determines a distribution color X which is a color of a variable color subframe, and then selects pixels sequentially to perform the following processing on the selected pixel P. Distributed brightness (Dsr, Dsg, Dsb) is calculated based on brightnesses Dr, Dg, Db and the distribution color X, and a distribution ratio α is set to a value of 1 at which color breakup is the smallest. An evaluation value Qi related to a color difference when a line of sight moves is calculated based on brightness of the selected pixel P, brightnesses of neighboring pixels Pi (i=1 to N), and the distribution color X, and the distribution ratio α is decreased in steps until the maximum value Qmax of the evaluation value Qi is less than or equal to a threshold value Qth. The brightnesses Dr, Dg, Db of three colors are converted to brightnesses Ex, Er, Eg, Eb of four colors based on the distribution color X and the distribution ratio α
(Continued)

determined for each pixel. This suppresses irregular flicker that occurs in the vicinity a boundary of pixel areas of different colors.

17 Claims, 17 Drawing Sheets

(51) Int. Cl.
*G09G 3/34* (2006.01)
*G09G 5/10* (2006.01)

(52) U.S. Cl.
CPC ..... *G09G 3/36* (2013.01); *G09G 5/10* (2013.01); *G09G 2310/0235* (2013.01); *G09G 2310/08* (2013.01); *G09G 2320/0247* (2013.01); *G09G 2320/0276* (2013.01); *G09G 2320/0686* (2013.01); *G09G 2360/16* (2013.01)

(56) References Cited

FOREIGN PATENT DOCUMENTS

| | | | |
|---|---|---|---|
| JP | 2003/140617 | A | 5/2003 |
| JP | 2003/241714 | A | 8/2003 |
| JP | 2003/248462 | A | 9/2003 |
| JP | 2006/293095 | A | 10/2006 |
| JP | 2010/096894 | A | 4/2010 |
| WO | WO-2012/099039 | A1 | 7/2012 |

| | | | | |
|---|---|---|---|---|
| P1 | P2 | P3 | P4 | P5 |
| P6 | P7 | P8 | P9 | P10 |
| P11 | P12 | P | P13 | P14 |
| P15 | P16 | P17 | P18 | P19 |
| P20 | P21 | P22 | P23 | P24 |

| SUBJECTIVE ESTIMATION RESULT | KBGR SYSTEM | WBGR SYSTEM | YBGR SYSTEM (THIS EMBODIMENT) |
|---|---|---|---|
| COLOR BREAKUP NEAR BOUNDARY | ○ | △ | ○ |
| COLOR BREAKUP IN WHITE REGION | × | ○ | △ |
| COLOR BREAKUP IN YELLOW REGION | × | × | ○ |
| IRREGULAR FLICKER | ○ | × | ○ |

| SUBJECTIVE ESTIMATION RESULT | KBGR SYSTEM | WBGR SYSTEM | YBGR SYSTEM | WYBGR SYSTEM (PRIORITY -TO-WHITE) | WYBGR SYSTEM (PRIORITY -TO-YELLOW) |
|---|---|---|---|---|---|
| COLOR BREAKUP NEAR BOUNDARY | ○ | △ | ○ | ○ | ○ |
| COLOR BREAKUP IN WHITE REGION | × | ○ | △ | ○ | △ |
| COLOR BREAKUP IN YELLOW REGION | × | × | ○ | ○ | ○ |
| IRREGULAR FLICKER | ○ | × | ○ | × | ○ |

| | | | | |
|---|---|---|---|---|
| 1 | 2 | 4 | 2 | 1 |
| 2 | 4 | 8 | 4 | 2 |
| 4 | 8 | P | 8 | 4 |
| 2 | 4 | 8 | 4 | 2 |
| 1 | 2 | 4 | 2 | 1 |

*Fig. 22*

| | | | | | |
|---|---|---|---|---|---|
| M1 | M2 | M1 | M2 | M1 | M2 |
| M2 | M1 | M2 | M1 | M2 | M1 |
| M1 | M2 | M1 | M2 | M1 | M2 |
| M2 | M1 | M2 | M1 | M2 | M1 |
| M1 | M2 | M1 | M2 | M1 | M2 |
| M2 | M1 | M2 | M1 | M2 | M1 |

FIELD-SEQUENTIAL IMAGE DISPLAY DEVICE AND IMAGE DISPLAY METHOD

TECHNICAL FIELD

The present invention relates to an image display device, and more specifically relates to a field-sequential image display device and a field-sequential image display method.

BACKGROUND ART

There has been known a field-sequential image display device for displaying a plurality of subframes in one frame period. For example, a typical field-sequential image display device is provided with a backlight including red, green, and blue light sources, and displays red, green, and blue subframes in one frame period. When the red subframe is to be displayed, a display panel is driven based on red video data, and the red light source emits light. Subsequently, the green subframe and the blue subframe are displayed in a similar manner. The three subframes displayed in a time-division manner are synthesized on retinas of an observer by an afterimage phenomenon, and recognized as one color image by the observer.

In the field-sequential image display device, when a line of sight of the observer moves within a display screen, the observer may see the colors of the respective subframes separate from each other (this phenomenon is called color breakup). As a method for suppressing the color breakup, there is known a method of displaying at least one color component of red, green and blue in two or more subframes in one frame period. For example, in a field-sequential image display device for displaying white, red, green, and blue subframes in one frame period, the red color component is displayed in the red and white subframes, the green color component is displayed in the green and white subframes, and the blue color component is displayed in the blue and white subframes.

In relation to the present invention, the following techniques have been known. Patent Document 1 describes that in a field-sequential image display device for displaying white, red, green, and blue subframes in one frame period, a display gradation level which is lower than the lowest value of the display gradation levels of red, green, and blue pixel data is defined as white pixel data, and the white pixel data is subtracted from the red, green, and blue pixel data.

Patent Document 2 describes that in a field-sequential display device for displaying at least each one of a three primary color subfield that displays red, green, or blue video, an in-between color subfield that displays in-between color video, and an achromatic color subfield that displays achromatic color video in one frame period, brightness of a video signal is distributed preferentially in the order of the achromatic color subfield, the in-between color subfield, and the three primary color subfield. Paragraph 0047 describes that a distribution ratio of color components except an achromatic color component is determined in accordance with which of color breakup or color rainbow is to be reduced more.

Patent Document 3 describes that in a field-sequential liquid crystal display device for displaying white, red, green, and blue subframes in one frame period, gradation of white is determined from gradation of red, green, and blue, brightness of four colors is calculated from the gradation of four colors, the brightness of red, green, and blue is determined based on the brightness of white, and the gradation of red, green, and blue is calculated from the brightness of red, green, and blue.

PRIOR ART DOCUMENTS

Patent Documents

[Patent Document 1] Japanese Laid-Open Patent Publication No. 2002-318564

[Patent Document 2] Japanese Laid-Open Patent Publication No. 2003-241714

[Patent Document 3] Japanese Laid-Open Patent Publication No. 2006-293095

SUMMARY OF THE INVENTION

Problems to be Solved by the Invention

In the field-sequential image display device, when pixel areas of different colors are adjacent to each other in a display screen, irregular flicker may occur on the boundary of the pixel areas. Hereinafter, an image display device, which displays white, blue, green, and red subframes in one frame period and defines the minimum value of gradation of red, green, and blue as gradation of white for each pixel, is referred to as a "conventional image display device."

As shown in FIG. 24, there is considered a case where a pixel area PA that displays yellow and a pixel area PB that displays white are adjacent to each other. FIG. 25 is a diagram showing brightness of each subframe and integrated brightness of pixels in the pixel areas PA, PB in the conventional image display device. As shown in FIG. 25, the brightness of the pixel in the pixel area PA is zero (denoted by Wmin, Bmin in FIG. 25) in the white and blue subframes, and is the maximum value (denoted by Gmax, Rmax in FIG. 25) in the green and red subframes.

The brightness of the pixel in the pixel area PB is the maximum value (denoted by Wmax in FIG. 25) in the white subframe, and is zero (denoted by Bmin, Gmin, Rmin in FIG. 25) in the blue, green, and red subframes.

Arrows V1, V2 shown in FIG. 25 represent directions of lines of sight of the observer. Since the eyes of the observer always move irregularly (involuntary eye movement during fixation), the line of sight of the observer moves irregularly in the left direction (V1 direction) and the right direction (V2 direction). At this time, the observer observes a result of integrating the brightness of the pixels in the direction of the line of sight (hereinafter referred to as integrated brightness). As shown in FIG. 25, a difference occurs between the integrated brightness when the line of sight moves in the left direction and the integrated brightness when the line of sight moves in the right direction. For this reason, the colors of the pixel areas PA, PB look different to the observer between when the line of sight moves in the left direction and when the line of sight moves in the right direction. As a result, the observer recognizes irregular flicker that occurs in the vicinity of the boundary of the pixel areas PA, PB.

The irregular flicker also occurs on a boundary of a pixel area that displays white and a pixel area that displays green, and a boundary of a pixel area that displays white and a pixel area that displays cyan. In the image display devices described in Patent Documents 1 to 3, the irregular flicker that occurs in the vicinity of a boundary of pixel areas of different colors cannot be suppressed sufficiently.

Accordingly, it is an object of the present invention to suppress irregular flicker that occurs in the vicinity of a boundary of pixel areas of different colors in a field-sequential image display device.

Means for Solving the Problems

According to a first aspect of the present invention, there is provided a field-sequential image display device including: a subframe data generator for generating output brightness data corresponding to a plurality of subframes based on input brightness data corresponding to a plurality of color components; and a display for displaying the plurality of subframes including a variable color subframe for which a color is selectable, in one frame period in accordance with a video signal based on the output brightness data, wherein the subframe data generator determines, based on the input brightness data, a distribution color which is the color of the variable color subframe, and generates the output brightness data with regard to each pixel based on the input brightness data by determining a distribution ratio for each pixel based on brightness of the pixel, brightness of neighboring pixels and the distribution color, and distributing the brightness of the pixel to the plurality of subframes based on the distribution color and the distribution ratio.

According to a second aspect of the present invention, in the first aspect of the present invention, after determining the distribution color, the subframe data generator, with regard to each pixel, calculates an evaluation value related to a color difference when a line of sight moves, based on the brightness of the pixel, the brightness of the neighboring pixels and the distribution color, and determines the distribution ratio based on the evaluation value.

According to a third aspect of the present invention, in the second aspect of the present invention, with regard to each pixel and each neighboring pixel, the subframe data generator calculates integrated brightness when the line of sight moves and integrated brightness when the line of sight is fixed, and calculates the evaluation value based on variations in the two kinds of integrated brightness.

According to a fourth aspect of the present invention, in the third aspect of the present invention, with regard to each pixel and each neighboring pixel, the subframe data generator calculates, as the evaluation value, a ratio of the variation in the integrated brightness when the line of sight is fixed with respect to the variation in the integrated brightness when the line of sight moves.

According to a fifth aspect of the present invention, in the fourth aspect of the present invention, the subframe data generator includes a distribution color determinator for determining the distribution color based on the input brightness data; a distributed brightness calculator for calculating distributed brightness data representing brightness to be distributed to the plurality of subframes based on the input brightness data and the distribution color; an integrated brightness calculator for calculating the two kinds of integrated brightness based on the input brightness data, the distributed brightness data, and the distribution color; and an output brightness calculator for generating the output brightness data by calculating the evaluation value based on the two kinds of integrated brightness, determining the distribution ratio based on the evaluation value, and distributing the brightness of the pixel contained in the input brightness data to the plurality of subframes based on the distribution color and the distribution ratio.

According to a sixth aspect of the present invention, in the second aspect of the present invention, with regard to each pixel, the subframe data generator determines the distribution ratio such that a maximum value of the evaluation values is less than or equal to a threshold.

According to a seventh aspect of the present invention, in the sixth aspect of the present invention, the subframe data generator determines the distribution ratio with regard to each pixel by setting the distribution ratio to the maximum value at first, and decreasing the distribution ratio in steps until the maximum value of the evaluation value is less than or equal to the threshold.

According to an eighth aspect of the present invention, in the first aspect of the present invention, the display switches the color of the variable color subframe for an entire display screen, and the subframe data generator determines one distribution color for the entire display screen based on the input brightness data.

According to a ninth aspect of the present invention, in the first aspect of the present invention, the display has a function of dividing a display screen into a plurality of areas and switching the color of the variable color subframe for each area, and the subframe data generator determines the distribution color for each area based on the input brightness data.

According to a tenth aspect of the present invention, in the first aspect of the present invention, the display displays a plurality of variable color subframes in one frame period, and the subframe data generator determines an order for distributing the brightness of the pixel to the plurality of the variable color subframes, and distributes the brightness of the pixel to the plurality of the subframes based on the distribution color, the order, and the distribution ratio.

According to an eleventh aspect of the present invention, in the second aspect of the present invention, with regard to each pixel and each neighboring pixel, the subframe data generator makes the evaluation value larger as a distance between the pixel and the neighboring pixel is smaller.

According to a twelfth aspect of the present invention, in the second aspect of the present invention, with regard to each pixel and each neighboring pixel, the subframe data generator makes a value to be compared with the evaluation value smaller as a distance between the pixel and the neighboring pixel is smaller.

According to a thirteenth aspect of the present invention, in the second aspect of the present invention, with regard to each pixel, the subframe data generator smooths the distribution ratio determined based on the evaluation value in a time axial direction, and distributes the brightness of the pixel to the plurality of subframes based on the distribution color and the smoothed distribution ratio.

According to a fourteenth aspect of the present invention, in the thirteenth aspect of the present invention, the subframe data generator determines the distribution color by smoothing a color obtained based on the input brightness data, in a time axial direction.

According to a fifteenth aspect of the present invention, in the first aspect of the present invention, the subframe data generator has a plurality of methods for determining the distribution ratio, and switches the methods for determining the distribution ratio in units of a pixel.

According to a sixteenth aspect of the present invention, there is provided a field-sequential image display method including: a step of generating output brightness data corresponding to a plurality of subframes based on input brightness data corresponding to a plurality of color components; and a step of displaying the plurality of subframes including a variable color subframe for which a color is selectable, in one frame period in accordance with a video signal based on the output brightness data, wherein in the step of generating, a distribution color which is the color of the variable color subframe is determined based on the input brightness data, and the output brightness data is generated with regard to each pixel based on the input brightness data by determining a distribution ratio for each pixel based on brightness of the pixel, brightness of neighboring pixels, and the distribution color, and distributing the brightness of the pixel to the plurality of subframes based on the distribution color and the distribution ratio.

According to a seventeenth aspect of the present invention, there is provided a field-sequential image display device including: a subframe data generator for generating output brightness data corresponding to a plurality of subframes based on input brightness data corresponding to a plurality of color components; and a display for displaying a plurality of fixed color subframes in one frame period in accordance with a video signal based on the output brightness data, wherein the subframe data generator determines an order for distributing brightness of a pixel to the plurality of the fixed color subframes, and generates the output brightness data with regard to each pixel based on the input brightness data by determining a distribution ratio for each pixel based on the brightness of the pixel and brightness of neighboring pixels, and distributing the brightness of the pixel to the plurality of subframes based on the order and the distribution ratio.

Effects of the Invention

According to the first or sixteenth aspect of the present invention, in a field-sequential image display device (or image display method) having a variable color subframe, a distribution color which is a color of the variable color subframe is determined, and when output brightness data is to be generated, a distribution ratio is determined for each pixel based on brightness of the pixel, brightness of neighboring pixels, and the distribution color, and the brightness of the pixel is distributed to a plurality of subframes based on the distribution color and the distribution ratio, whereby it is possible to distribute the brightness of the pixel to the plurality of subframes at a suitable ratio, and thus suppress irregular flicker that occurs in the vicinity of the boundary of pixel areas of different colors.

According to the second aspect of the present invention, after determining the distribution color, an evaluation value related to a color difference when a line of sight moves is calculated for each pixel, and the distribution ratio is determined based on the calculated evaluation value, whereby it is possible to distribute the brightness of the pixel at a suitable ratio in consideration of the color difference when the line of sight moves, and thus suppress the irregular flicker.

According to the third aspect of the present invention, based on a variation in integrated brightness when the line of sight moves and a variation in integrated brightness when the line of sight is fixed, it is possible to calculate a suitable evaluation value for suppressing the irregular flicker.

According to the fourth aspect of the present invention, a ratio of the variation in the integrated brightness when the line of sight is fixed with respect to the variation in the integrated brightness when the line of sight moves is calculated, whereby it is possible to calculate a suitable evaluation value for suppressing the irregular flicker.

According to the fifth aspect of the present invention, it is possible to constitute a subframe data generator of the image display device capable of suppressing the irregular flicker using a distribution color determinator, a distributed brightness calculator, an integrated brightness calculator, and an output brightness calculator.

According to the sixth aspect of the present invention, with regard to each pixel, the distribution ratio is determined such that the maximum value of the evaluation value is less than or equal to a threshold, whereby it is possible to suppress the irregular flicker to a predetermined degree.

According to the seventh aspect of the present invention, with regard to each pixel, the distribution ratio is decreased in steps until the maximum value of the evaluation value is less than or equal to the threshold, whereby it is possible to suppress color breakup while suppressing the irregular flicker to the predetermined degree.

According to the eighth aspect of the present invention, effects similar to those of the first aspect can be attained in an image display device in which a color of the variable color subframe is selectable for the entire display screen.

According to the ninth aspect of the present invention, effects similar to those of the first aspect can be attained in an image display device in which a color of the variable color subframe is selectable for each area. Furthermore, by switching the distribution color for each area of the display screen, it is possible to switch the distribution color in accordance with local characteristics of the display screen, and effectively suppress the irregular flicker that occurs in the vicinity of the boundary of the pixel areas of different colors.

According to the tenth aspect of the present invention, in a field-sequential image display device having a plurality of variable color subframes, an order for distributing the brightness of the pixel to the plurality of variable color subframes is determined suitably, whereby it is possible to suppress the irregular flicker effectively.

According to the eleventh aspect of the present invention, the evaluation value is made larger for the closer neighboring pixel to have a larger effect on determination of the distribution ratio, whereby it is possible to change the distribution ratio spatially smoothly, and thus improve the image quality of a display image.

According to the twelfth aspect of the present invention, the value to be compared with the evaluation value is made smaller for the closer neighboring pixel to have a larger effect on determination of the distribution ratio, whereby it is possible to change the distribution ratio spatially smoothly, and thus improve the image quality of the display image.

According to the thirteenth aspect of the present invention, the distribution ratio is smoothed in a time axial direction to change the distribution ratio temporally smoothly, thus enabling improvement in image quality of the display image.

According to the fourteenth aspect of the present invention, the distribution color is smoothed in a time axial direction to change the distribution color temporally smoothly, thus enabling improvement in image quality of the display image.

According to the fifteenth aspect of the present invention, the distribution ratio determining method is switched in units of a pixel, to disperse within the display image the color breakup and the irregular flicker which cannot be suppressed only by applying one distribution ratio determining method, thus enabling improvement in image quality of the display image.

According to the seventeenth aspect of the present invention, in a field-sequential image display device having a plurality of fixed color subframes, an order for distributing the brightness of the pixel to the plurality of fixed color subframes is determined suitably, whereby it is possible to suppress the irregular flicker effectively.

BRIEF DESCRIPTION OF THE DRAWINGS

FIG. 22 is a diagram showing a distribution ratio determining method in an image display device according to a seventh embodiment of the present invention.

MODES FOR CARRYING OUT THE INVENTION

Figure 1:
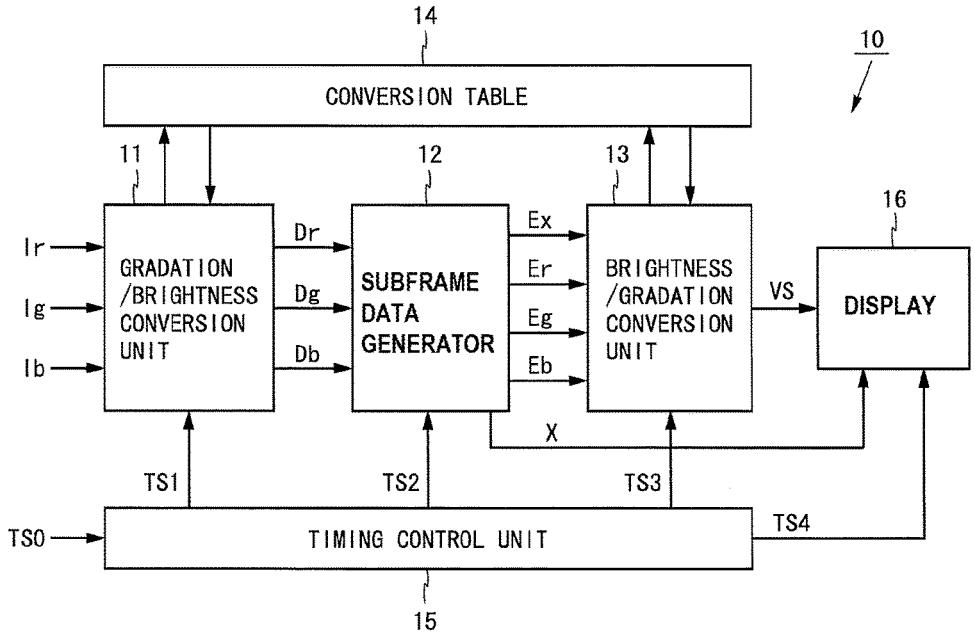
FIG. 1 is a block diagram showing a configuration of an image display device according to a first embodiment of the present invention.

Hereinafter, image display devices according to embodiments of the present invention will be described referring to the drawings. In the following description, when c1, c2, . . . , cn represent colors, a field-sequential image display device which displays subframes of colors c1, c2, . . . , cn sequentially in one frame period is referred to as "c1 c2 . . . cn system image display device". Red, green, blue, white, cyan, magenta, yellow, and black are denoted by R, G, B, W, C, M, Y, and K, respectively, and a color of a subframe for which the color is selectable (hereinafter referred to as variable color subframe) is referred to as a distribution color, and is denoted by X. For example, an image display device which sequentially displays white, blue, green, and red subframes in one frame period is referred to as "WBGR system image display device", and an image display device which sequentially displays a variable color subframe and the blue, green, and red subframes is referred to as "XBGR system image display device".

First Embodiment

FIG. 1 is a block diagram showing a configuration of an image display device according to a first embodiment of the present invention. An image display device 10 shown in FIG. 1 is an XBGR system image display device including a gradation/brightness conversion unit 11, a subframe data generator 12, a brightness/gradation conversion unit 13, a conversion table 14, a timing control unit 15, and a display 16. The image display device 10 divides one frame period into first to fourth subframe periods. The image display device 10 displays a subframe of a distribution color X in the first subframe period, and displays blue, green, and red subframes in the second to fourth subframe periods, respectively. In the following description, it is assumed that the distribution color X is determined from among white, cyan, magenta, and yellow.

As illustrated in FIG. 1, input gradation data corresponding to color components of three colors is input from the outside into the image display device 10. The input gradation data includes red gradation data Ir, green gradation data Ig, and blue gradation data Ib. The input gradation data represents gradation of each pixel.

The gradation/brightness conversion unit 11 performs inverse-gamma conversion to convert the input gradation data to input brightness data. The input brightness data represents brightness of each pixel. The gradation/brightness conversion unit 11 converts the red gradation data Ir, the green gradation data Ig, and the blue gradation data Ib respectively to red brightness data Dr, green brightness data Dg, and blue brightness data Db. Hereinafter, it is assumed that the brightness represented by each of the red brightness data Dr, the green brightness data Dg, and the blue brightness data Db is regulated with the maximum brightness being 1.

The subframe data generator 12 generates output brightness data corresponding to the subframes of four colors based on the input brightness data corresponding to the three color components. The output brightness data represents brightness of each pixel. Based on the brightness data Dr, Dg, Db of three colors, the subframe data generator 12 determines one distribution color X from among white, cyan, magenta, and yellow for an entire display screen, and generates brightness data Ex, Er, Eg, Eb of four colors.

The brightness/gradation conversion unit 13 performs gamma conversion to convert the output brightness data to output gradation data. The output gradation data represents gradation of each pixel. The brightness/gradation conversion unit 13 converts the brightness data Ex, Er, Eg, Eb of four colors respectively to display gradation data of four colors (display gradation data of distribution color X, red, green, and blue), and outputs a video signal VS containing the display gradation data of four colors.

The conversion table 14 stores data required for inverse-gamma conversion in the gradation/brightness conversion unit 11 and for gamma conversion in the brightness/gradation conversion unit 13. Based on a timing control signal TS0 supplied from the outside of the image display device 10, the timing control unit 15 outputs timing control signals TS1 to TS4 respectively to the gradation/brightness conversion unit 11, the subframe data generator 12, the brightness/gradation conversion unit 13, and the display 16. The display 16 performs field-sequential drive based on the video signal VS, the timing control signal TS4, and the distribution color X to display four subframes in one frame period.

Figure 2:
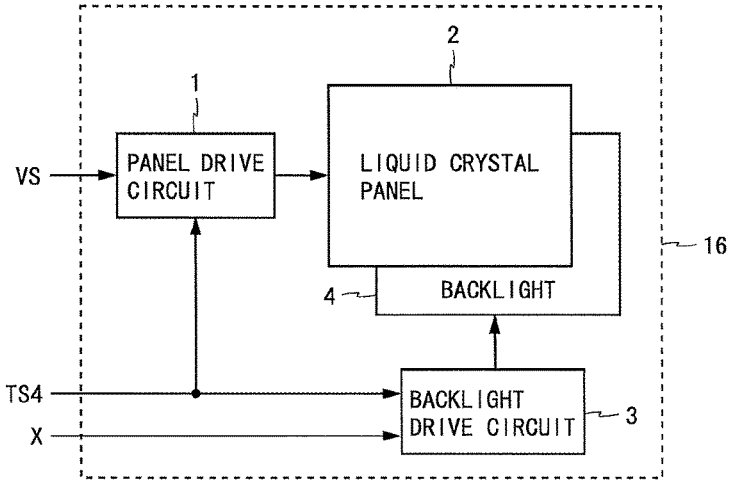
FIG. 2 is a block diagram showing a configuration of a display shown in FIG. 1.

FIG. 2 is a block diagram showing a configuration of the display 16. The display 16 shown in FIG. 2 includes a panel drive circuit 1, a liquid crystal panel 2, a backlight drive circuit 3, and a backlight 4. The liquid crystal panel 2 includes a plurality of pixels arranged two-dimensionally (not shown). The panel drive circuit 1 drives the liquid crystal panel 2 based on the video signal VS and the timing control signal TS4. The panel drive circuit 1 drives the liquid crystal panel 2 based on the display gradation data of the distribution color X, blue, green, and red in the first to fourth subframe periods, respectively.

The backlight 4 includes a red light source, a green light source, and a blue light source (none of which is shown). For the light source of the backlight 4, an LED (Light Emitting Diode) is used, for example. In each subframe period, the backlight drive circuit 3 causes the light source to emit light in accordance with the color of the subframe based on the timing control signal TS4 and the distribution color X. Specifically, the backlight drive circuit 3 causes the blue light source to emit light in the second subframe period, causes the green light source to emit light in the third subframe period, causes the red light source to emit light in the fourth subframe period.

In the first subframe period, the backlight drive circuit 3 causes the red, green, and blue light sources to emit light when the distribution color X is white, causes the green and blue light sources to emit light when the distribution color X is cyan, causes the red and blue light sources to emit light when the distribution color X is magenta, and causes the red and green light sources to emit light when the distribution color X is yellow. Thereby, the distribution color X, blue, green, and red subframes are displayed on the liquid crystal panel 2 sequentially in one frame period. As thus described, the display 16 switches the color of the variable color subframe for the entire display screen. Note that the configuration of the display 16 is not limited to the configuration shown in FIG. 2.

In the image display device 10, brightness of each pixel contained in the brightness data Ex (hereinafter referred to as the brightness of the distribution color X subframe) of the distribution color X can be determined within a range from 0 to the minimum value of the brightness of three primary colors contained in the distribution color X. Specifically, brightness of the white subframe can be determined within a range from 0 to the minimum value of the brightness of red, green, and blue, brightness of the cyan subframe can be determined within a range from 0 to the minimum value of the brightness of green and blue, brightness of the magenta subframe can be determined within a range from 0 to the minimum value of the brightness of red and blue, and brightness of the yellow subframe can be determined within a range from 0 to the minimum value of the brightness of red and green.

Increasing the brightness of the distribution color X subframe can suppress the color breakup, but increases the tendency of the irregular flicker to occur in the vicinity of the boundary of the pixel areas of different colors. On the contrary, lowering the brightness of the distribution color X subframe can suppress the irregular flicker, but increases the tendency of the color breakup to occur. To suppress the color breakup and the irregular flicker suitably, the subframe data generator 12 determines the distribution color X and the brightness of the distribution color X subframe by a method shown below. Hereinafter, a ratio of the brightness of the distribution color X subframe with respect to the maximum value that can be taken by the brightness of the distribution color X subframe is referred to as a "distribution ratio $\alpha$".

Figures 3, 4:
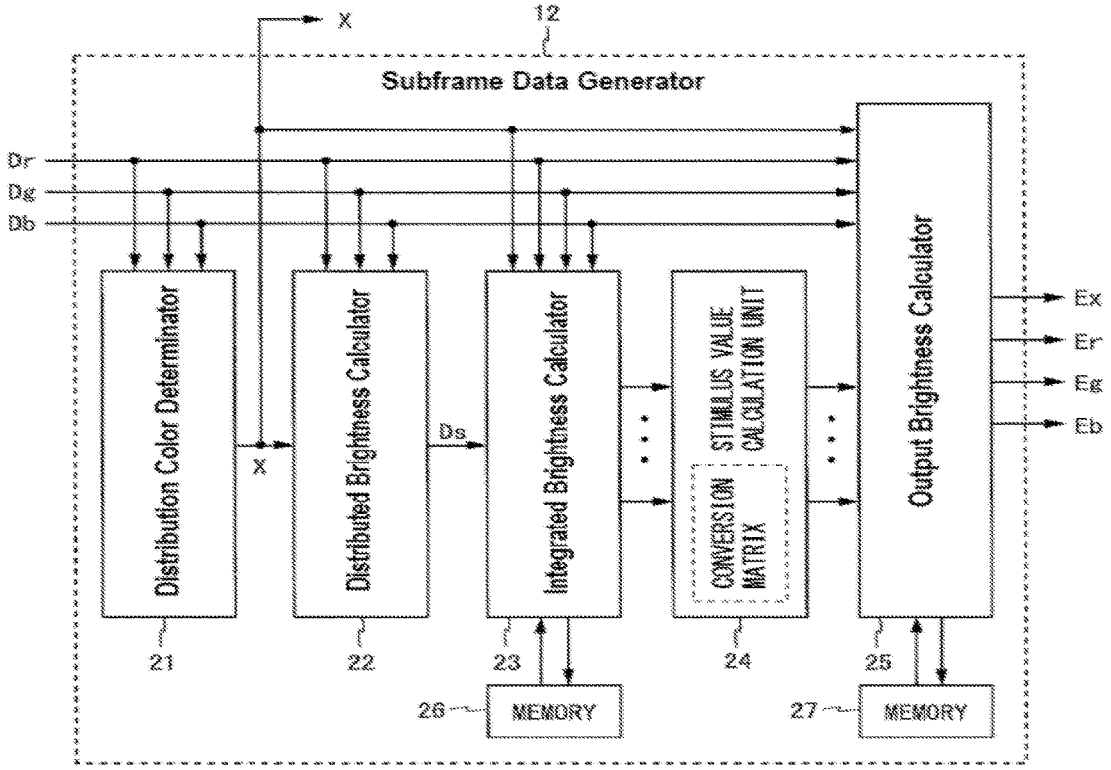
FIG. 3 is a block diagram showing a detailed configuration of a subframe data generator shown in FIG. 1.
FIG. 4 is a diagram showing an example of neighboring pixels in the image display device shown in FIG. 1.

FIG. 3 is a block diagram showing a detailed configuration of the subframe data generator 12. As shown in FIG. 3, the subframe data generator 12 includes a distribution color determinator 21, a distributed brightness calculator 22, an integrated brightness calculator 23, a stimulus value calculation unit 24, an output brightness calculator 25, and memories 26, 27. The subframe data generator 12 determines the distribution color X, and then selects pixels sequentially to perform processing shown in FIGS. 5 and 6 on the pixel which is selected. Hereinafter, the pixel which is selected is referred to as a selected pixel, and pixels close to the selected pixel are referred to as neighboring pixels. The subframe data generator 12 generates the output brightness data with regard to each selected pixel based on the input brightness data by determining the distribution ratio $\alpha$ for each pixel based on brightness of the selected pixel, brightness of the neighboring pixels, and the distribution color X, and distributing the brightness of the selected pixel to a plurality of subframes in accordance with the distribution color X and the calculated distribution ratio $\alpha$. In the following example, as shown in FIG. 4, 24 pixels P1 to P24, located within a range of two pixels arranged horizontally from a selected pixel P and two pixels arranged vertically from the selected pixel P, are taken as neighboring pixels.

The memory 26 is a working memory of the integrated brightness calculator 23, and the memory 27 is a working memory of the output brightness calculator 25. The distribution color determinator 21 determines one distribution color X for the entire display screen based on the input brightness data. For example, the distribution color determinator 21 calculates the number of data close to white, the number of data close to cyan, the number of data close to magenta, and the number of data close to yellow included in the input brightness data, and determines the distribution color X to be a color corresponding to the maximum number in the calculated numbers (first method). The first method is a method for determining the distribution color X, considering that the color breakup is to be suppressed preferentially.

Alternatively, the distribution color determinator 21 may determine the distribution color X by the following method, considering the irregular flicker that occurs at the boundary of pixel areas (second method). When a screen is displayed by using the first method, the irregular flicker may occur depending on a combination of a color of a pixel and colors of surrounding pixels. For example, when the distribution color X is determined to be white in a case where many combinations of white and yellow are included in the display screen, the irregular flicker may occur in the vicinity of the boundary of two pixel areas, and the image quality may degrade. Thus, in the second method, when many combinations of colors of pixels with which the irregular flicker occurs are included in the display screen, the distribution color X is determined to be a color different from that determined by the first method. For example, the distribution color determinator 21 determines the distribution color X to be yellow when there are many combinations of white and yellow, determines the distribution color X to be green when there are many combinations of white and green, and determines the distribution color X to be cyan when there are many combinations of white and cyan. The reason for this is that the irregular flicker is strongly recognized in the combination of white and yellow, the combination of white and green, and the combination of white and cyan. According to the second method, the color breakup can be suppressed to some extent, with suppressing the irregular flicker.

Alternatively, the distribution color determinator 21 may evaluate the degree that the irregular flicker is recognized, based on the brightness of the pixel and the brightness of the neighboring pixels, and may determine the distribution color X in accordance with the evaluation result (third method). The distribution color determinator 21 may determine the distribution color X by an arbitrary method, not limited to the above-described first to third methods.

Based on the input brightness data and the distribution color X, the distributed brightness calculator 22 calculates distributed brightness data Ds representing brightness to be distributed to a plurality of subframes (hereinafter referred to as distributed brightness). More specifically, the distributed brightness includes a red component Dsr, a green component Dsg, and a blue component Dsb, and is denoted by (Dsr, Dsg, Dsb). The distributed brightness calculator 22 calculates (D0, D0, D0) (D0 is the minimum value of the brightness data Dr, Dg, Db of three colors) as the distributed brightness when the distribution color X is white, calculates (0, D1, D1) (D1 is the minimum value of the brightness data Dg, Db of two colors) as the distributed brightness when the distribution color X is cyan, calculates (D2, 0, D2) (D2 is the minimum value of the brightness data Dr, Db of two colors) as the distributed brightness when the distribution color X is magenta, and calculates (D3, D3, 0) (D3 is the minimum value of the brightness data Dr, Dg of two colors) as the distributed brightness when the distribution color X is yellow. The distributed brightness calculator 22 outputs the distributed brightness data Ds containing the calculated minimum value.

Based on the input brightness data, the distributed brightness data Ds, and the distribution color X, the integrated brightness calculator 23 calculates integrated brightness when a line of sight moves and integrated brightness when the line of sight is fixed. More specifically, the integrated brightness calculator 23 calculates integrated brightness assuming that the distribution color is X and the distribution ratio is $\alpha$, based on the brightness data Dr, Dg, Db and the distributed brightness data Ds of three colors of the selected pixel, and the brightness data and the distributed brightness data of three colors of the neighboring pixels which are stored in the memory 26.

The stimulus value calculation unit 24 performs RGB-XYZ conversion to convert the integrated brightness when the line of sight moves and the integrated brightness when the line of sight is fixed, calculated by the integrated brightness calculator 23, to tristimulus values. The output brightness calculator 25 generates the output brightness data based on the input brightness data, the tristimulus values calculated by the stimulus value calculation unit 24, and the distribution color X.

Figure 5:
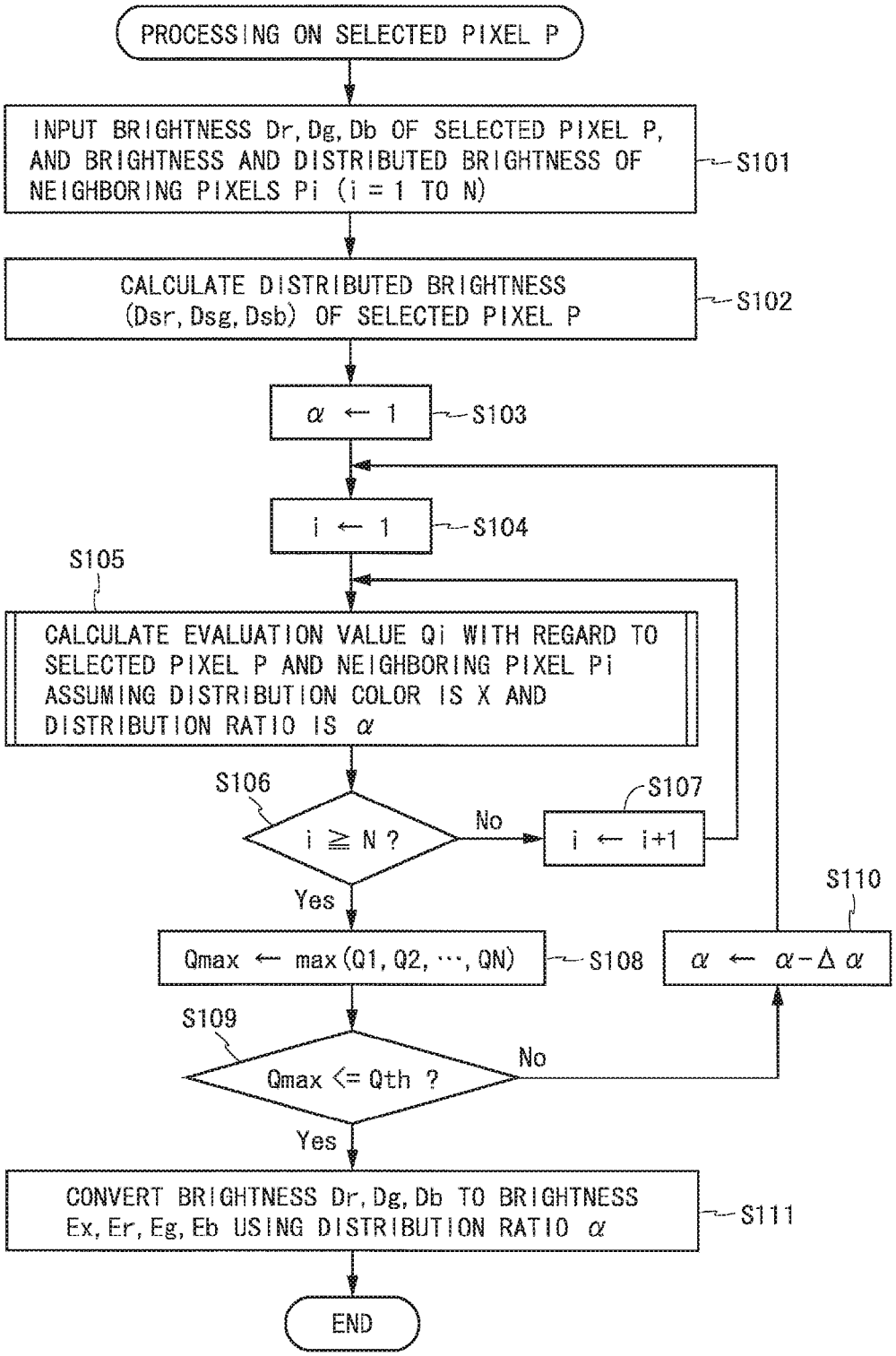
FIG. 5 is a flowchart showing processing performed on a selected pixel in the image display device according to the first embodiment.
Figure 6:
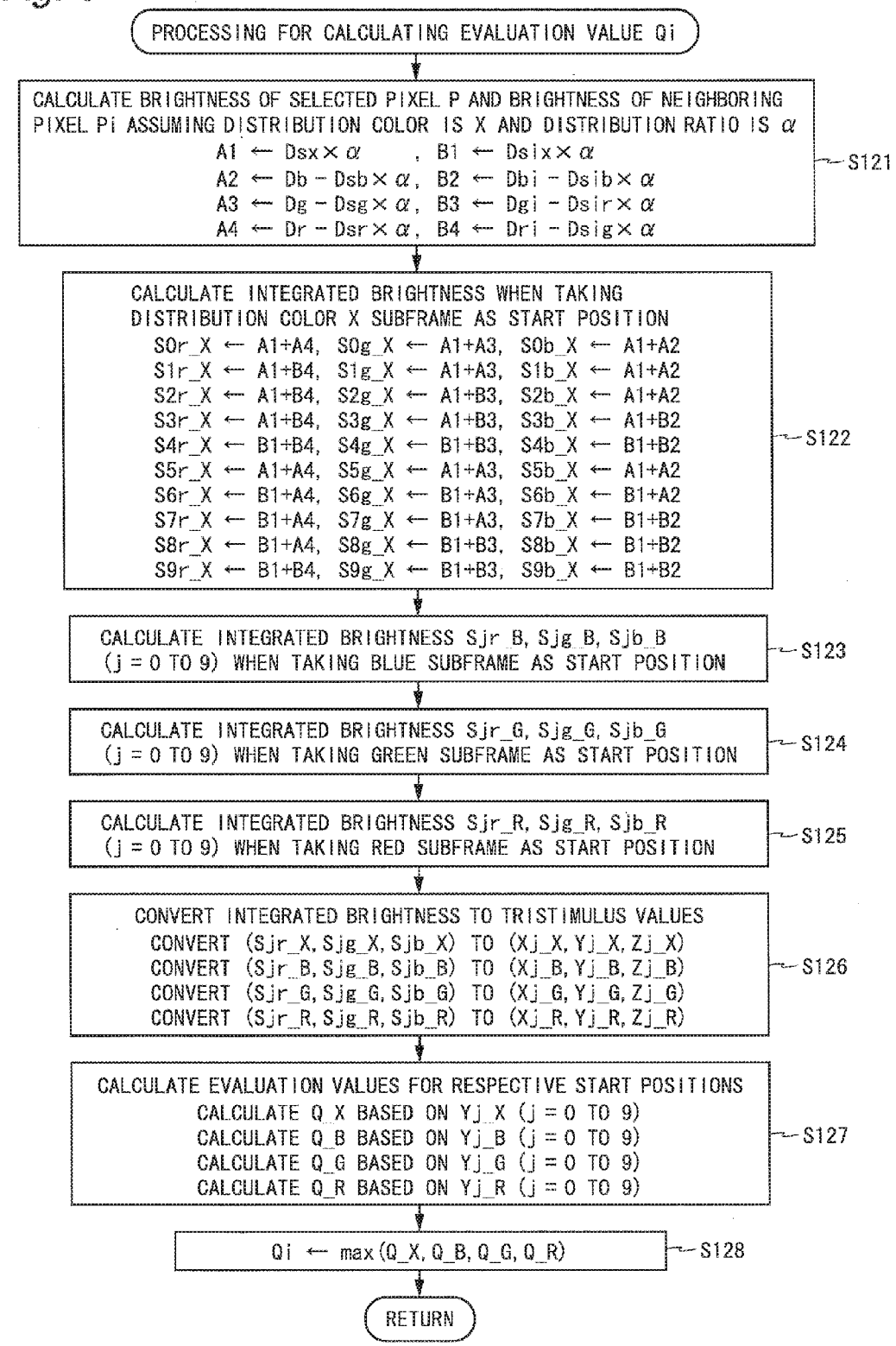
FIG. 6 is a flowchart showing a detail of step S105 shown in FIG. 5.

FIG. 5 is a flowchart showing processing performed on the selected pixel P by the subframe data generator 12. FIG. 6 is a flowchart showing a detail of step S105 (processing for calculating an evaluation value Qi). Hereinafter, the number of neighboring pixels (24, herein) is represented by N, the brightness of three colors of the selected pixel P is represented by Dr, Dg, Dg, the brightness of three colors of the neighboring pixel Pi (i=1 to N) is represented by Dri, Dgi, Dbi, and distributed brightness of the neighboring pixel Pi is represent by Dsi. Of steps shown in FIGS. 5 and 6, step S102 is performed by the distributed brightness calculator 22, steps S121 to S125 are performed by the integrated brightness calculator 23, step S126 is performed by the stimulus value calculation unit 24, and the other steps are performed by the output brightness calculator 25. The subframe data generator 12 may perform steps in parallel, which can be performed in parallel, out of the steps shown in FIGS. 5 and 6.

First, the brightness Dr, Dg, Db of the selected pixel P, the brightness Dri, Dgi, Dbi of the N neighboring pixels Pi, and the distributed brightness Dsi of the N neighboring pixels Pi are input to the subframe data generator 12 (step S101). Note that the brightness and the distributed brightness of the neighboring pixels Pi are stored in the memory 26 before step S101 is performed. Next, the distributed brightness calculator 22 calculates distributed brightness (Dsr, Dsg, Dsb) of the selected pixel P by the above-described method (step S102). Next, the output brightness calculator 25 sets 1 to the distribution ratio $\alpha$ (step S103). The value of 1 set in step S103 is a value at which the color breakup is the smallest.

Next, the subframe data generator 12 performs steps S104 to S110 repeatedly until Yes is determined in step S109. In step S104, the output brightness calculator 25 assigns 1 to a variable i. Next, the subframe data generator 12 performs the processing shown in FIG. 6, to calculate the evaluation value Qi with regard to the selected pixel P and the neighboring pixel Pi assuming that the distribution color is X and the distribution ratio is $\alpha$ (step S105). Next, the output brightness calculator 25 determines whether or not i is N or larger (step S106). When No is determined in step S106, the output brightness calculator 25 adds 1 to the variable i (step S107) and goes to step S105. When Yes is determined in step S106, the output brightness calculator 25 goes to step S108.

In step S108, the output brightness calculator 25 calculates the maximum value Qmax of the N evaluation values Qi. Next, the output brightness calculator 25 determines whether or not the maximum value Qmax of the evaluation values is less than or equal to a threshold Qth which is determined in advance (step S109). When No is determined in step S109, the output brightness calculator 25 subtracts a predetermined value $\Delta\alpha$ (>0) from the distribution ratio $\alpha$ (step S110) and goes to step S104. When Yes is determined in step S109, the output brightness calculator 25 goes to step S111.

The distribution ratio $\alpha$ of the selected pixel P is determined by the processing before step S111. The output brightness calculator 25 converts the brightness Dr, Dg, Db of three colors of the selected pixel P to brightness Ex, Er, Eg, Eb of four colors using the determined distribution ratio $\alpha$ (step S111). Specifically, the output brightness calculator 25 performs the following calculation.

$$Ex=Dsx\times\alpha$$

$$Er=Dr-Dsr\times\alpha$$

$$Eg=Dg-Dsg\times\alpha$$

$$Eb=Db-Dsb\times\alpha$$

However, Dsx is the minimum value of Dsr, Dsg, and Dsb when the distribution color X is white, is the minimum value of Dsg and Dsb when the distribution color X is cyan, is the minimum value of Dsr and Dsb when the distribution color X is magenta, and is the minimum value of Dsr and Dsg when the distribution color X is yellow.

In FIG. 6, the integrated brightness calculator 23 calculates the brightness of the selected pixel P and the brightness of the neighboring pixel Pi assuming that the distribution color is X and the distribution ratio is $\alpha$ (step S121). Specifically, the integrated brightness calculator 23 performs the following calculation.

$$A1=Dsx\times\alpha,\ B1=Dsix\times\alpha$$

$$A2=Db-Dsb\times\alpha,\ B2=Dbi-Dsib\times\alpha$$

$$A3=Dg-Dsg\times\alpha,\ B3=Dgi-Dsig\times\alpha$$

$$A4=Dr-Dsr\times\alpha,\ B4=Dri-Dsir\times\alpha$$

However, Dsir, Dsig, and Dsib are a red component, a green component, and a blue component of the distributed brightness Dsi of the neighboring pixel Pi, respectively, and Dsix is the minimum value of Dsir, Dsig, and Dsib when the distribution color X is white, is the minimum value of Dsig and Dsib when the distribution color X is cyan, is the minimum value of Dsir and Dsib when the distribution color X is magenta, and is the minimum value of Dsir and Dsig when the distribution color X is yellow.

Figure 7:
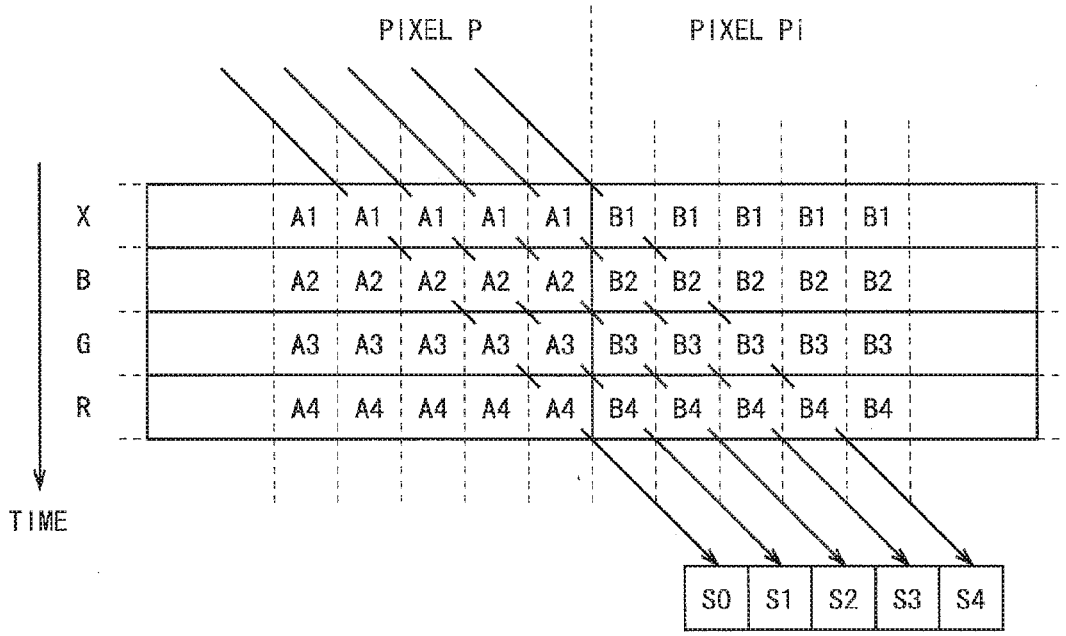
FIG. 7 is a diagram showing a method for calculating integrated brightness in a case where a line of sight moves in the right direction.
Figure 8:
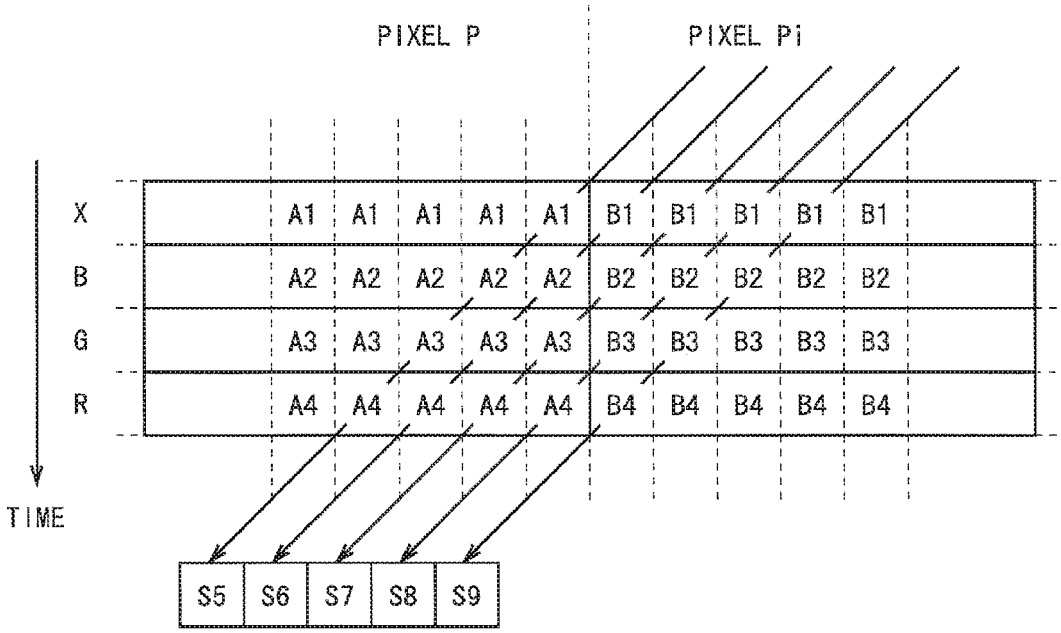
FIG. 8 is a diagram showing a method for calculating integrated brightness in a case where the line of sight moves in the left direction.

Next, the integrated brightness calculator 23 calculates integrated brightness Sjr_X, Sjg_X, Sjb_X (j=0 to 9) when taking the distribution color X subframe as a start position (step S122). FIG. 7 is a diagram showing a method for calculating integrated brightness when taking the distribution color X subframe as the start position and the line of sight of the observer moves in the right direction. FIG. 8 is a diagram showing a method for calculating integrated brightness when taking the distribution color X subframe as the start position and the line of sight of the observer moves in the left direction. The subframe data generator 12 adds up the brightness of the subframes in an oblique arrow direction shown in each of FIGS. 7 and 8, to calculate integrated brightness.

For example, the integrated brightness calculator 23 performs the following calculation, to calculate integrated brightness at a position S1.

$$S1r_X=A1+B4,\ S1g_X=A1+A3,\ S1b_X=A1+A2$$

Further, the integrated brightness calculator 23 performs the following calculation, to calculate integrated brightness at positions S0 and S2 to S9.

$$S0r_X=A1+A4,\ S0g_X=A1+A3,\ S0b_X=A1+A2,$$

$$S2r_X=A1+B4,\ S2g_X=A1+B3,\ S2b_X=A1+A2,$$

$$S3r_X=A1+B4,\ S3g_X=A1+B3,\ S3b_X=A1+B2,$$

$$S4r_X=B1+B4,\ S4g_X=B1+B3,\ S4b_X=B1+B2,$$

$$S5r_X=A1+A4,\ S5g_X=A1+A3,\ S5b_X=A1+A2,$$

$$S6r_X=B1+A4,\ S6g_X=B1+A3,\ S6b_X=B1+A2,$$

$$S7r_X=B1+A4,\ S7g_X=B1+A3,\ S7b_X=B1+B2,$$

$$S8r_X=B1+A4,\ S8g_X=B1+B3,\ S8b_X=B1+B2,$$

$$S9r_X=B1+B4,\ S9g_X=B1+B3,\ S9b_X=B1+B2$$

Next, the integrated brightness calculator 23 performs the following calculation, to calculate integrated brightness Sjr_B, Sjg_B, Sjb_B (j=0 to 9) when taking the blue subframe as the start position (step S123).

$$S0r_B=A4+A1,\ S0g_B=A3+A1,\ S0b_B=A2+A1,$$

$$S1r_B=A4+B1,\ S1g_B=A3+B1,\ S1b_B=A2+B1,$$

$$S2r_B=B4+B1,\ S2g_B=A3+B1,\ S2b_B=A2+B1,$$

$$S3r_B=B4+B1,\ S3g_B=B3+B1,\ S3b_B=A2+B1,$$

$$S4r_B=B4+B1,\ S4g_B=B3+B1,\ S4b_B=B2+B1,$$

$$S5r_B=A4+A1,\ S5g_B=A3+A1,\ S5b_B=A2+A1,$$

$$S6r_B=A4+A1,\ S6g_B=A3+A1,\ S6b_B=B2+A1,$$

$$S7r_B=A4+A1,\ S7g_B=B3+A1,\ S7b_B=B2+A1,$$

$$S8r_B=B4+A1,\ S8g_B=B3+A1,\ S8b_B=B2+A1,$$

$$S9r_B=B4+B1,\ S9g_B=B3+B1,\ S9b_B=B2+B1$$

Next, the integrated brightness calculator 23 performs the following calculation, to calculate integrated brightness Sjr_G, Sjg_G, Sjb_G (j=0 to 9) when taking the green subframe as the start position (step S124).

$$S0r_G=A4+A1,\ S0g_G=A3+A1,\ S0b_G=A1+A2,$$

$$S1r_G=A4+A1,\ S1g_G=A3+A1,\ S1b_G=A1+B2,$$

$$S2r_G=A4+B1,\ S2g_G=A3+B1,\ S2b_G=B1+B2,$$

$$S3r_G=B4+B1,\ S3g_G=A3+B1,\ S3b_G=B1+B2,$$

$$S4r_G=B4+B1,\ S4g_G=B3+B1,\ S4b_G=B1+B2,$$

$$S5r_G=A4+A1,\ S5g_G=A3+A1,\ S5b_G=A1+A2,$$

$$S6r_G=A4+A1,\ S6g_G=B3+A1,\ S6b_G=A1+A2,$$

$$S7r_G=B4+A1,\ S7g_G=B3+A1,\ S7b_G=A1+A2,$$

$$S8r_G=B4+B1,\ S8g_G=B3+B1,\ S8b_G=B1+A2,$$

$$S9r_G=B4+B1,\ S9g_G=B3+B1,\ S9b_G=B1+B2$$

Next, the integrated brightness calculator 23 performs the following calculation, to calculate integrated brightness Sjr_R, Sjg_R, Sjb_R (j=0 to 9) when taking the red subframe as the start position (step S125).

$$S0r_R=A4+A1,\ S0g_R=A1+A3,\ S0b_R=A1+A2,$$

$$S1r_R=A4+A1,\ S1g_R=A1+B3,\ S1b_R=A1+A2,$$

$$S2r_R=A4+A1,\ S2g_R=A1+B3,\ S2b_R=A1+B2,$$

$$S3r_R=A4+B1,\ S3g_R=B1+B3,\ S3b_R=B1+B2,$$

$$S4r_R=B4+B1,\ S4g_R=B1+B3,\ S4b_R=B1+B2,$$

$$S5r_R=A4+A1,\ S5g_R=A1+A3,\ S5b_R=A1+A2,$$

$$S6r_R=B4+A1,\ S6g_R=A1+A3,\ S6b_R=A1+A2,$$

$$S7r_R=B4+B1,\ S7g_R=B1+A3,\ S7b_R=B1+A2,$$

$$S8r_R=B4+B1,\ S8g_R=B1+A3,\ S8b_R=B1+B2,$$

$$S9r_R=B4+B1,\ S9g_R=B1+B3,\ S9b_R=B1+B2$$

Next, the stimulus value calculation unit 24 converts the integrated brightness calculated in steps S122 to S125 to tristimulus values (step S126). The stimulus value calculation unit 24 includes a conversion matrix for converting brightness of the RGB color system to stimulus values of the XYZ color system. The stimulus value calculation unit 24 performs the RGB-XYZ conversion using the conversion matrix, to convert the integrated brightness (Sjr_X, Sjg_X, Sjb_X) (j=0 to 9) to tristimulus values (Xj_X, Yj_X, Zj_X) (j=0 to 9) when taking the distribution color X subframe as the start position. In a similar manner, the stimulus value calculation unit 24 converts the integrated brightness (Sjr_B, Sjg_B, Sjb_B) (j=0 to 9) to tristimulus values (Xj_B, Yj_B, Zj_B) (j=0 to 9) when taking the blue subframe as the start position, converts the integrated brightness (Sjr_G, Sjg_G, Sjb_G) (j=0 to 9) to tristimulus values (Xj_G, Yj_G, Zj_G) (j=0 to 9) when taking the green subframe as the start position, and converts the integrated brightness (Sjr_R, Sjg_R, Sjb_R) (j=0 to 9) to tristimulus values (Xj_R, Yj_R, Zj_R) (j=0 to 9) when taking the red subframe as the start position.

Next, based on the tristimulus values calculated in step S126, the output brightness calculator 25 calculates evaluation values Q_X, Q_B, Q_G, Q_R with regard to the respective start positions (step S127). In the present embodiment, the output brightness calculator 25 calculates the evaluation values Q_X, Q_B, Q_G, Q_R using a Y value of the tristimulus values.

Figure 9:
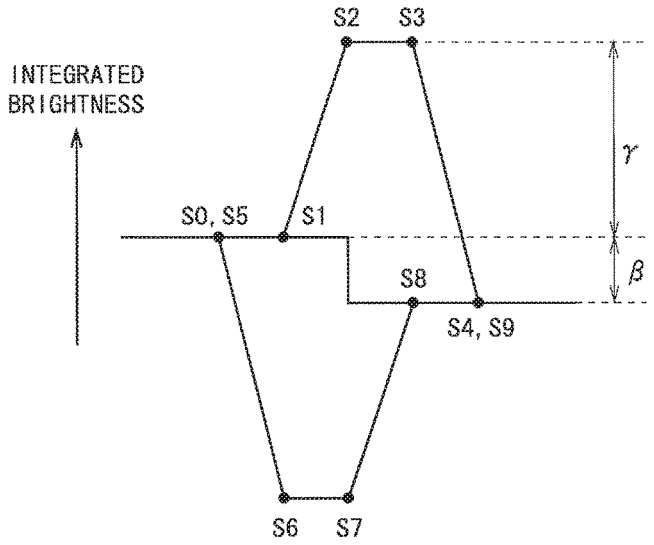
FIG. 9 is a diagram showing integrated brightness calculated by the image display device according to the first embodiment.

FIG. 9 is a diagram showing integrated brightness at the positions S0 to S9. In FIG. 9, β represents a variation in the integrated brightness (Y value) when the line of sight is fixed, and γ represents a variation in the integrated brightness (Y value) when the line of sight moves. The variation β in the integrated brightness when the line of sight is fixed is given by |Y0_X−Y9_X|. The variation γ in the integrated brightness when the line of sight moves is given by the maximum value of min(|Yj_X−Y0_X|, |Yj_X−Y9_X|). The output brightness calculator 25 calculates the variation β when the line of sight is fixed and the variation γ when the line of sight moves based on ten Y values Y0_X to Y9_X when taking the distribution color X subframe as the start position, and defines a ratio γ/β of the variation γ with respect to the variation β as the evaluation value Q_X when taking the color X subframe as the start position.

In a similar manner, the output brightness calculator 25 calculates the evaluation value Q_B when taking the blue subframe as the start position based on ten Y values Y0_B to Y9_B when taking the blue subframe as the start position, calculates the evaluation value Q_G when taking the green subframe as the start position based on ten Y values Y0_G to Y9_G when taking the green subframe as the start position, and calculates the evaluation value Q_R when taking the red subframe as the start position based on ten Y values Y0_R to Y9_R when taking the red subframe as the start position.

Next, the output brightness calculator 25 calculates the maximum value of the four evaluation values Q_X, Q_B, Q_G, Q_R calculated in step S127, and defines the calculated maximum value as the evaluation value Qi assuming that the distribution color is X and the distribution ratio is α with regard to the selected pixel P and the neighboring pixel Pi (step S128).

Although the stimulus value calculation unit 24 converts the integrated brightness to the tristimulus values in the above description, the stimulus value calculation unit 24 may only calculate a value which is required for calculating the evaluation value (Y value, herein), out of the tristimulus values based on the integrated brightness.

Figure 24:
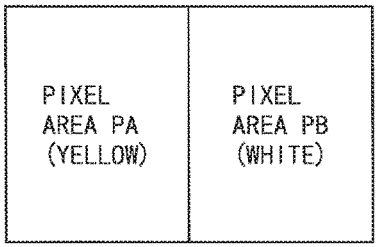
FIG. 24 is a diagram showing a state where two pixel areas are adjacent to each other.
Figure 25:
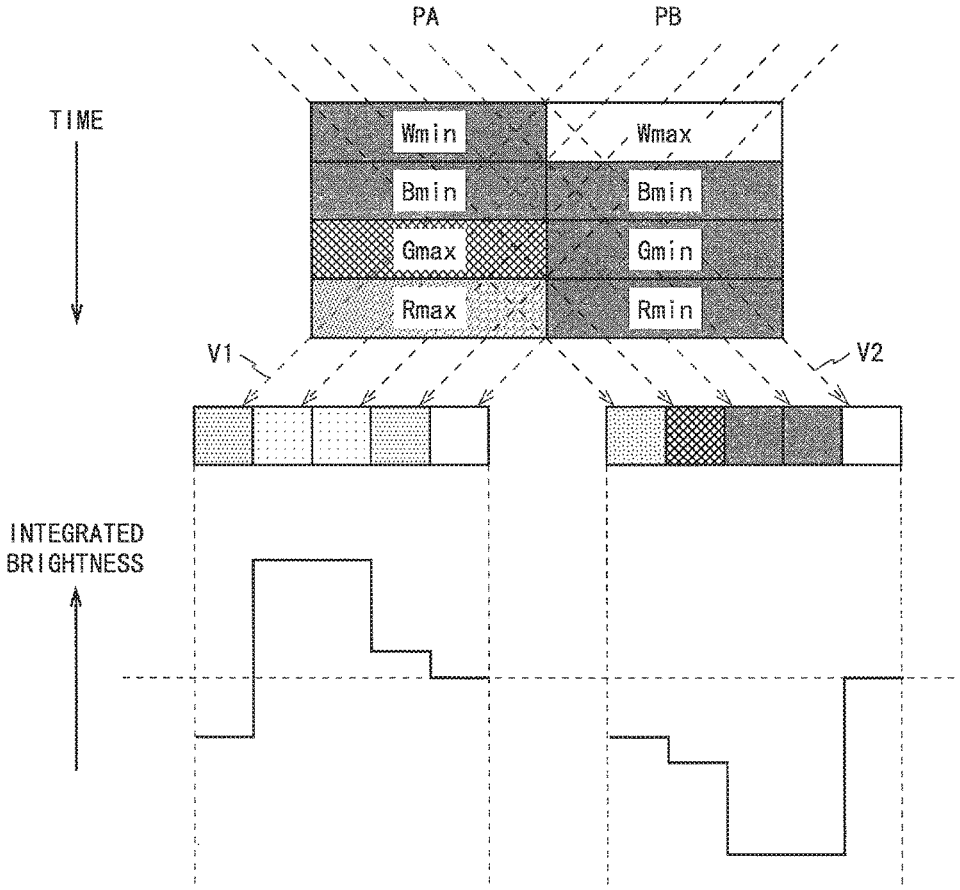
FIG. 25 is a diagram showing brightness of each subframe and integrated brightness in a conventional image display device.

Hereinafter, effects of the image display device 10 according to the present embodiment are described in comparison with a WBGR system image display device. As an example, there is considered a case where a pixel area PA that displays yellow and a pixel area PB that displays white are adjacent to each other as shown in FIG. 24. As described with reference to FIG. 25, in the WBGR system image display device, a difference occurs between the integrated brightness when the line of sight moves in the left direction and the integrated brightness when the line of sight moves in the right direction. For this reason, the colors of the pixel areas PA, PB look different to the observer between when the line of sight moves in the left direction and when the line of sight moves in the right direction. As a result, the observer recognizes irregular flicker that occurs in the vicinity of the boundary of the pixel areas PA, PB.

Figure 10:
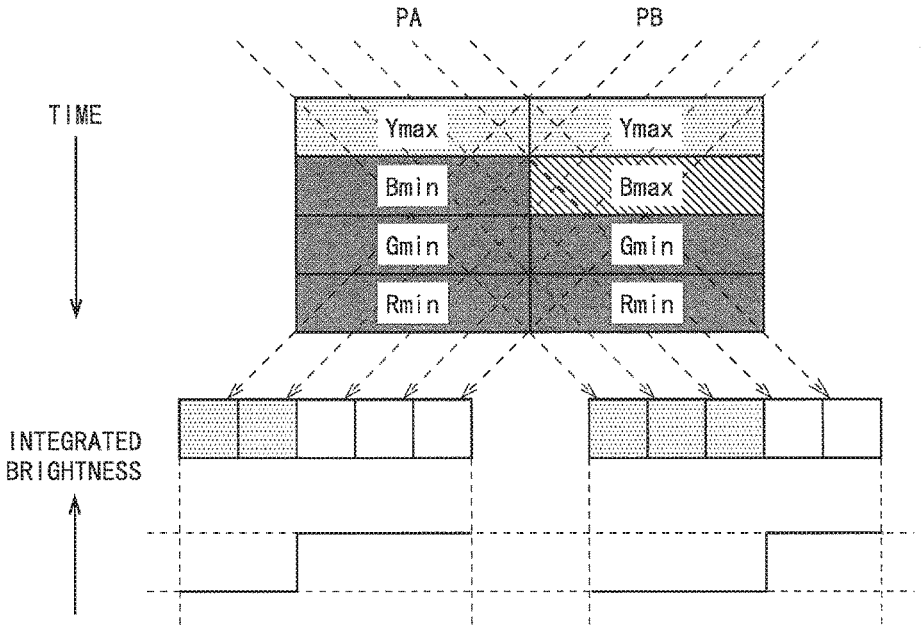
FIG. 10 is a diagram showing brightness of each subframe and integrated brightness in the image display device according to the first embodiment.

The image display device 10 is an XBGR system image display device, and the distribution color X is determined from among white, cyan, magenta, and yellow. When an image shown in FIG. 24 is to be displayed, the distribution color determinator 21 determines the distribution color X to be yellow. FIG. 10 is a diagram showing brightness of each subframe and integrated brightness of pixels in the pixel areas PA, PB when the distribution color X is determined to be yellow in the image display device 10. As shown in FIG. 10, the brightness of the pixel in the pixel area PA is the maximum value (denoted by Ymax in FIG. 10) in the yellow subframe, and is zero (denoted by Bmin, Gmin, Rmin in FIG. 10) in the blue, green, and red subframes. The brightness of the pixel in the pixel area PB is the maximum value (denoted by Ymax, Bmax in FIG. 10) in the yellow subframe and the blue subframe, and is zero (denoted by Gmin, Rmin in FIG. 10) in the green and red subframes.

As shown in FIG. 10, in the image display device 10, there is a small difference between the integrated brightness when the line of sight moves in the left direction and the integrated brightness when the line of sight moves in the right direction. As understood by comparing with FIG. 24, the difference of the integrated brightness in the image display device 10 is smaller than the difference of the integrated brightness in the WBGR system image display device. As thus described, according to the image display device 10 according to the present embodiment, it is possible to suppress the irregular flicker that occurs in the vicinity of the boundary of the pixel areas of different colors, by suitably determining the distribution color X (color of variable color subframe).

Figures 11, 12:
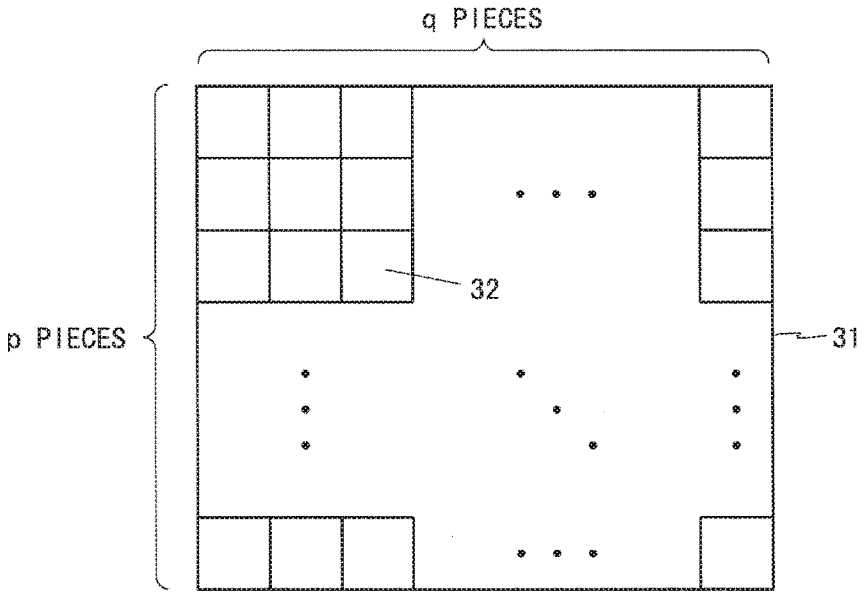
FIG. 11 is a diagram showing subjective evaluation results of an image in the image display device according to the first embodiment and image display devices of comparative examples.
FIG. 12 is a diagram showing a dividing method of a display screen in an image display device according to a second embodiment of the present invention.

FIG. 11 is a diagram showing subjective evaluation results when an image shown in FIG. 24 is displayed by a KBGR system image display device, a WBGR system image display device, and the image display device 10 according to the present embodiment in which the distribution color X is determined to be yellow. In FIG. 11, a circle mark represents that there is no problem, a triangle mark represents that there is a small problem, and a cross mark represents that there is a problem.

According to the KBGR system image display device, color breakup in the vicinity of the boundary of the areas and irregular flicker in the vicinity of the boundary of the areas can be suppressed, but color breakup in a white area and color breakup in a yellow area cannot be suppressed. According to the WBGR system image display device, the color breakup in the white area can be suppressed, the color breakup in the vicinity of the boundary of the areas can be suppressed to some extent, but the color breakup in the yellow area and the irregular flicker in the vicinity of the boundary of the areas cannot be suppressed.

On the contrary, when the distribution color X is determined to be yellow in the image display device 10 according to the present embodiment, the color breakup in the white area can be suppressed to some extent, and the color breakup in the vicinity of the boundary of the areas, the color breakup in the yellow area, and the irregular flicker in the vicinity of the boundary of the areas can be suppressed. According to the image display device 10 of the present embodiment, since three out of the four problems can be suppressed effectively, image quality of the display image can be improved than the KBGR system or WBGR system image display device.

Further, the subframe data generator 12 determines the distribution ratio $\alpha$ by setting the distribution ratio $\alpha$ to the maximum value at first and decreasing the distribution ratio $\alpha$ in steps until the maximum value Qmax of the evaluation value is less than or equal to the threshold Qth. As thus described, the distribution ratio $\alpha$ is determined to be the maximum value at which the irregular flicker can be suppressed to the predetermined degree. As the distribution ratio $\alpha$ is larger, the color breakup that occurs on the display screen is smaller. Thus, according to the image display device 10, it is possible to suppress the color breakup while suppressing the irregular flicker to the predetermined degree.

Further, in the conventional image display device (a WBGR system image display device which defines for each pixel the minimum value of gradation of red, green, and blue as gradation of white), when two areas that display different colors are displayed and the display screen is scrolled in a direction orthogonal to the boundary of the areas, the observer may recognize the boundary of the areas as being emphasized. According to the image display device 10 of the present embodiment, it is also possible to suppress unnecessary emphasis that occurs on a boundary of areas when displaying a moving image.

Moreover, when frame interpolation processing is not performed in an image display device in which the number of subframes displayed in one frame period is larger than the number of color components contained in input video data as in the conventional image display device, the observer may recognize judder (a phenomenon of jerky movement of an image) that occurs in the vicinity of the boundary of the areas. According to the image display device 10 of the present embodiment, it is also possible to suppress the judder that occurs in the vicinity of the boundary of the areas.

As shown above, in the image display device 10 according to the present embodiment, the display 16 displays, in one frame period, a plurality of subframes including a variable color subframe for which a color is selectable. The subframe data generator 12 determines the distribution color X (color of variable color subframe), and then generates the output brightness data with regard to each selected pixel P based on the input brightness data by determining the distribution ratio $\alpha$ for each pixel based on the brightness of the selected pixel P, the brightness of the neighboring pixels Pi, and the distribution color X, and distributing the brightness of the pixel to a plurality of subframes based on the distribution color X and the determined distribution ratio $\alpha$. As thus described, by determining the distribution color X which is the color of the variable color subframe and determining the distribution ratio $\alpha$ for each pixel, it is possible to distribute the brightness of the pixel to a plurality of subframes at a suitable ratio, and suppress the irregular flicker that occurs in the vicinity of the boundary of the pixel areas of different colors.

With regard to each selected pixel P, the subframe data generator 12 calculates the evaluation value Qi related to a color difference when the line of sight moves, based on the brightness of the selected pixel P, the brightness of the neighboring pixels Pi and the distribution color X, and determines the distribution ratio $\alpha$ based on the calculated evaluation value Qi. Hence it is possible to distribute the brightness of the pixel at a suitable ratio in consideration of the color difference when the line of sight moves, and thus suppress the irregular flicker.

With regard to each selected pixel P and each neighboring pixel Pi, the subframe data generator 12 calculates integrated brightness when the line of sight moves and integrated brightness when the line of sight is fixed, and calculates, as the evaluation value Qi, a ratio of a variation in the integrated brightness when the line of sight moves with respect to a variation in the integrated brightness when the line of sight is fixed, based on the variations in the two kinds of the integrated brightness. Hence it is possible to calculate an evaluation value suitable for suppressing the irregular flicker.

The subframe data generator 12 includes the distribution color determinator 21, the distributed brightness calculator 22, the integrated brightness calculator 23, and the output brightness calculator 25. The output brightness calculator 25 generates the output brightness data by calculating the evaluation value Qi based on the integrated brightness when the line of sight moves and the integrated brightness when the line of sight is fixed, determining the distribution ratio $\alpha$ based on the evaluation value Qi, and distributing the brightness of the pixel contained in the input brightness data to a plurality of subframes based on the distribution color X and the distribution ratio $\alpha$. Hence it is possible to constitute the subframe data generator 12 of the image display device 10 capable of suppressing the irregular flicker using the distribution color determinator 21, the distributed brightness calculator 22, the integrated brightness calculator 23, and the output brightness calculator 25. The subframe data generator 12 includes the stimulus value calculation unit 24 for converting the integrated brightness when the line of sight moves and the integrated brightness when the line of sight is fixed to stimulus values, and the output brightness calculator 25 calculates the evaluation value Qi based on the stimulus values. Hence it is possible to calculate an evaluation value which fits human visual characteristics.

The subframe data generator 12 determines the distribution ratio $\alpha$ such that the maximum value of the evaluation value Qi is less than or equal to the threshold Qth with regard to each selected pixel P. Hence it is possible to suppress the irregular flicker to the predetermined degree.

Further, with regard to each selected pixel P, the subframe data generator 12 determines the distribution ratio α by setting the distribution ratio α to the maximum value of 1 at first, and decreasing the distribution ratio α in steps until the maximum value Qmax of the evaluation value Qi is less than or equal to the threshold Qth. Hence it is possible to suppress the color breakup while suppressing the irregular flicker to the predetermined degree.

The image display device 10 is provided with the gradation/brightness conversion unit 11 and the brightness/gradation conversion unit 13, and the video signal VS is a signal based on output gradation data. Thus, even when input gradation data is input from the outside and the display 16 has a nonlinear characteristic, it is possible to constitute the image display device 10 capable of suppressing the irregular flicker using the gradation/brightness conversion unit 11 and the brightness/gradation conversion unit 13.

As for the image display device according to the present embodiment, it is possible to constitute the following modified examples. The subframe data generator 12 may perform processing, other than the processing shown in FIGS. 5 and 6, on the selected pixel P. For example, in steps S127 and S128, the output brightness calculator 25 may calculate the evaluation value Qi based on a variation in another value representing a color difference when the line of sight moves, in place of the variation in the Y value calculated by the stimulus value calculation unit 24. For example, the output brightness calculator 25 may calculate the evaluation value Qi based on an X value or a Z value of the tristimulus values, a value representing hue, brightness, or saturation, a value obtained by weighting and adding these values, or some other value. The value used for calculating the evaluation value Qi and coefficients of the weighted addition are preferably determined in accordance with an evaluation result of the display image.

Further, in place of the loop processing shown in FIG. 5 (steps S104 to S110), the subframe data generator 12 may determine the distribution ratio α immediately based on the evaluation value Qi assuming that the distribution ratio α is a certain value (hereinafter referred to as p). For example, the subframe data generator 12 may perform calculation shown in the following equation (1) based on N evaluation values Qi, to determine the distribution ratio α.

$$\alpha=\rho\times Qth/\max(Q1,Q2,\ldots,QN) \quad (1)$$

However, when α calculated in the equation (1) is larger than or equal to 1, α=1. According to the equation (1), when the maximum value of the evaluation value Qi is larger than the threshold Qth, the distribution ratio α is smaller than ρ (a temporary distribution ratio that is set when calculating the distribution ratio).

The subframe data generator 12 may determine the distribution ratio α using another calculation formula that makes the distribution ratio α smaller as the evaluation value Qi is larger. For example, the subframe data generator 12 may perform calculation shown in the following equation (2) to determine the distribution ratio α.

$$\alpha=T/\{(Q1+Q2+\ldots+QN)/N\} \quad (2)$$

Further, the subframe data generator 12 may perform calculation not including the threshold T, to determine the distribution ratio α. Moreover, the distributed brightness calculator 22 may calculate the minimum value of two or three values selected from the brightness data Dr, Dg, Db, and may obtain the distributed brightness data Ds including a value based on the calculated minimum value (e.g., a value smaller than the calculated minimum value by a predetermined amount) as each color component.

Further, in the above description, the distribution color determinator 21 determines the distribution color X from among white, cyan, magenta, and yellow. However, candidates for the distribution color X are not limited to these colors, and arbitrary colors except black may be the candidates for the distribution color X. For example, the distribution color determinator 21 may determine the distribution color X from among red, green, blue, and any other in-between colors in addition to white, cyan, magenta, and yellow.

When a color c is included in the candidates for the distribution color X, the subframe data generator 12 and the display 16 have functions corresponding to a color c subframe.

When the distribution color determinator 21 determines the distribution color X to be the color c, the backlight drive circuit 3 causes the red light source, the green light source, and the blue light source to emit light at a predetermined brightness, respectively in the color c subframe period. In step S102, the distributed brightness calculator 22 calculates the distributed brightness Ds of the selected pixel P by a method corresponding to the color c. In step S121, the integrated brightness calculator 23 calculates the brightness of the selected pixel P and the brightness of the neighboring pixel Pi by performing a calculation corresponding to the color c. In step S111, the output brightness calculator 25 converts the brightness Dr, Dg, Db of three colors of the selected pixel P to the brightness Ex, Er, Eg, Eb of four colors by performing a calculation corresponding to the color c.

Second Embodiment

An image display device according to a second embodiment of the present invention has the same configuration as that of the image display device according to the first embodiment. In the image display device according to the present embodiment, the display has a function of dividing a display screen into a plurality of areas and switching a color of a variable color subframe for each area, and the subframe data generator determines the distribution color X for each area based on the input brightness data. As thus described, the variable color subframe of the present embodiment is a subframe for which a color is selectable for each area.

FIG. 12 is a diagram showing a dividing method of a display screen in the image display device according to the present embodiment. As shown in FIG. 12, a display screen 31 is divided into (p×q) areas 32. The display 16 has a function of switching the color of the first subframe for each area. Specifically, the backlight 4 includes a plurality of red light sources, a plurality of green light sources, and a plurality of blue light sources, which are arranged two-dimensionally. One or more red light sources, one or more green light sources, and one or more blue light sources are associated to each area of the display screen. These light sources are controlled for each area. The backlight 4 is configured so that backlight light of one area does not mix with backlight light of other areas. For example, partitions may be provided at the boundaries of the areas, and the backlight 4 may be placed sufficiently close to the liquid crystal panel 2.

The distribution color determinator 21 determines the distribution color X for each area of the display screen based on the input brightness data. For example, the distribution color determinator 21 determines the distribution color X for each area by applying any of the first to third methods described in the first embodiment for each area. Alternatively, the distribution color determinator 21 may determine the distribution color X for each area by other methods than those described above. With this, (p x q) pieces of the distribution color X are determined for each frame.

In each subframe period, the backlight drive circuit 3 causes the light sources in accordance with the color of the subframe to emit light for each area, based on the timing control signal TS4 and the (p×q) pieces of the distribution color X.

Specifically, the backlight drive circuit 3 causes the blue light sources to emit light in all areas in the second subframe period, causes the green light sources to emit light in all areas in the third subframe period, and causes the red light sources to emit light in all areas in the fourth subframe period. In the first subframe period, the backlight drive circuit 3 causes the red, green, and blue light sources to emit light in the area of which the distribution color X is white, causes the green and blue light sources to emit light in the area of which the distribution color X is cyan, causes the red and blue light sources to emit light in the area of which the distribution color X is magenta, and causes the red and green light sources to emit light in the area of which the distribution color X is yellow.

With this, a subframe to which one of white, cyan, magenta, and yellow is assigned for each area, and the blue, green, and red subframes are sequentially displayed to the liquid crystal panel 2 in one frame period.

According to the image display device of the present embodiment, effects similar to those of the first embodiment can be attained. Further, by switching the distribution color X for each area of the display screen, it is possible to switch the distribution color X in accordance with local characteristics of the display screen, and effectively suppress the irregular flicker that occurs in the vicinity of the boundary of the pixel areas of different colors.

Third Embodiment

An image display device according to a third embodiment of the present invention has the same configuration as that of the image display device according to the first embodiment. In the image display device according to the present embodiment, as with the second embodiment, the display has a function of dividing a display screen into a plurality of areas and switching a color of a variable color subframe for each area, and the subframe data generator determines the distribution color X based on the input brightness data for each area. However, in the present embodiment, the backlight 4 is not necessarily configured so that backlight light of one area does not mix with backlight light of other areas.

Light emitted from each light source included in the backlight 4 has a spatial spread when entering the liquid crystal panel 2. In the present embodiment, the spatial spread of light emitted from each light source is measured in advance. The distribution color determinator 21 determines the distribution color X for each area of the display screen based on the input brightness data and the measurement result of the spatial spread. Specifically, the distribution color determinator 21 determines light-emitting status of the red, green, and blue light sources for each area so that necessary amount of backlight light can be obtained at all pixels in the liquid crystal panel 2 in the first subframe.

According to the image display device of the present embodiment, effects similar to those of the second embodiment can be attained.

Fourth Embodiment

An image display device according to a fourth embodiment of the present invention has the same configuration as that of the image display device according to the first embodiment. The image display device according to the present embodiment is characterized in that a plurality of variable color subframes are displayed in one frame period, and an order (hereinafter referred to as distribution order) of distributing the brightness of the pixel to the plurality of the variable color subframes is determined. A process for determining the distribution order is performed by the distribution color determinator 21.

Hereinafter, it is assumed that the image display device according to the present embodiment is an XXBGR system image display device, and that when the image shown in FIG. 24 is to be displayed, the distribution color of the first subframe is determined to be white, and the distribution color of the second subframe is determined to be yellow. In this case, when the brightness of the pixel is distributed to the first to fifth subframes, there can be considered a priority-to-white method in which the brightness is at first distributed preferentially to the first subframe, the brightness is next distributed to the second subframe, and then the brightness is distributed to the third to fifth subframes, and a priority-to-yellow method in which the brightness is at first distributed preferentially to the second subframe, the brightness is next distributed to the first subframe, and then the brightness is distributed to the third to fifth subframes.

Figure 13:
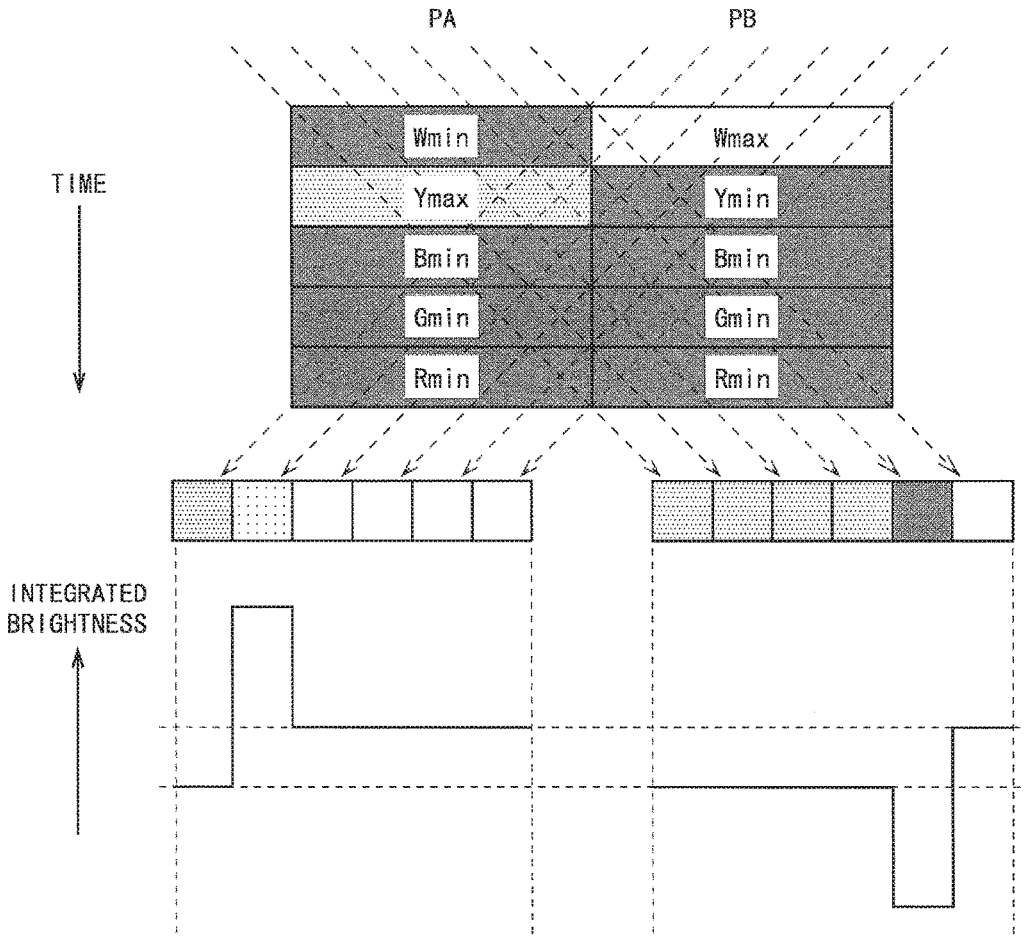
FIG. 13 is a diagram showing brightness of each subframe and integrated brightness when a priority-to-white method is used in an XXRGB system image display device.

FIG. 13 is a diagram showing brightness of each subframe and integrated brightness of the pixels in the pixel areas PA, PB when the priority-to-white method is used. As shown in FIG. 13, the brightness of the pixel in the pixel area PA is the maximum value (denoted by Ymax in FIG. 13) in the yellow subframe, and is zero (denoted by Wmin, Bmin, Gmin, Rmin in FIG. 13) in the other subframes. The brightness of the pixel in the pixel area PB is the maximum value (denoted by Wmax in FIG. 13) in the white subframe, and is zero (denoted by Ymin, Bmin, Gmin, Rmin in FIG. 13) in the other subframes. In this case, the integrated brightness is as shown in FIG. 13. When the priority-to-white method is used, color breakup in the vicinity of the boundary of the areas, color breakup in the white area, and color breakup in the yellow area can be suppressed, but irregular flicker in the vicinity of the boundary of the areas cannot be suppressed.

Figures 14, 15:
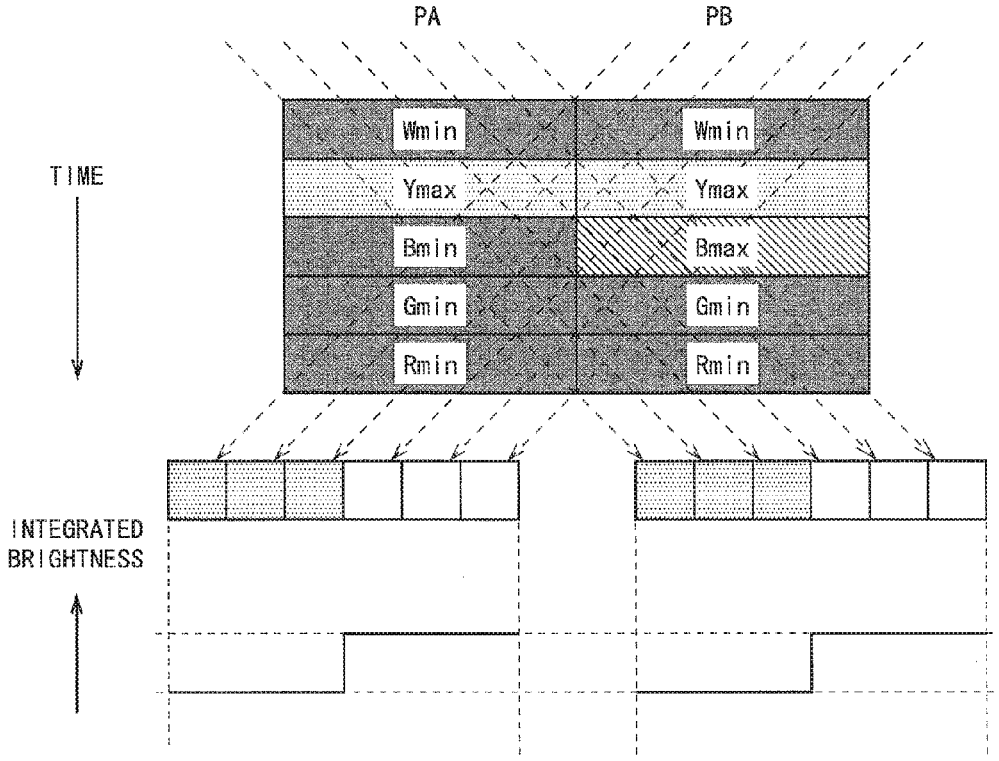
FIG. 14 is a diagram showing brightness of each subframe and integrated brightness when a priority-to-yellow method is used in the XXRGB system image display device.
FIG. 15 is a diagram showing subjective evaluation results of an image in an image display device according to a fourth embodiment of the present invention and image display devices of comparative examples.

FIG. 14 is a diagram showing brightness of each subframe and integrated brightness of the pixels in the pixel areas PA, PB when the priority-to-yellow method is used. As shown in FIG. 14, the brightness of the pixel in the pixel area PA is the same as that when the priority-to-white method is used. The brightness of the pixel in the pixel area PB is the maximum value (denoted by Ymax, Bmax in FIG. 14) in the yellow subframe and the blue subframe, and is zero (denoted by Ymin, Gmin, Rmin in FIG. 14) in the other subframes. In this case, the integrated brightness is as shown in FIG. 14. When the priority-to-yellow method is used, the color breakup in the vicinity of the boundary of the areas, the color breakup in the yellow area, and the irregular flicker in the vicinity of the boundary of the areas can be suppressed, with suppressing the color breakup in the white area to some extent.

FIG. 15 is a diagram showing subjective evaluation results when the image shown in FIG. 24 is displayed by a KBGR system image display device, a WBGR system image display device, a YBGR system image display device, a WYBGR system image display device using the priority-to-white method, and a WYBGR system image display device using the priority-to-yellow method. When the priority-to-yellow method is used in the WYBGR system image display device, three out of the four problems can be suppressed effectively. Thus, image quality of the display image can be improved than the KBGR system or WBGR system image display device, and the WYBGR system image display device using the priority-to-white method. As thus described, according to the image display device of the present embodiment, the image quality of the display image can be improved by suitably determining the distribution order among the plurality of the variable color subframes.

Note that an XXXBGR system or XXXW system image display device and the like may be constituted by a method similar to the XXBGR system image display device. In these image display devices, the distribution color X may be determined for the plurality of the variable color subframes, the distribution order may be determined among the plurality of the variable color subframes, and the distribution ratio $\alpha$ may be determined for each pixel.

Furthermore, as a modified example of the present embodiment, it is possible to constitute an image display device which determines a distribution order among a plurality of fixed color subframes and determines the distribution ratio $\alpha$ for each pixel. For example, in a WYBGR system image display device, the distribution order may be determined between the first and second subframes, and the distribution ratio $\alpha$ may be determined for each pixel. In this case, when the distribution order is determined to be "priority-to-first-subframe", the brightness is at first distributed preferentially to the white subframe which is the first subframe, the brightness is next distributed to the yellow subframe which is the second subframe, and then the brightness is distributed to the third to fifth subframes.

Furthermore, when the distribution order is determined to be "priority-to-second-subframe", the brightness is at first distributed preferentially to the yellow subframe which is the second subframe, the brightness is next distributed to the white subframe which is the first subframe, and then the brightness is distributed to the third to fifth subframes. Alternatively, in the WWBGR system image display device, the distribution order may be determined between the first and second subframes, and the distribution ratio $\alpha$ may be determined for each pixel. In this case, when the distribution order is determined to be "priority-to-first-subframe", the brightness is at first distributed preferentially to the white subframe which is the first subframe, the brightness is next distributed to the white subframe which is the second subframe, and then the brightness is distributed to the third to fifth subframes. Furthermore, when the distribution order is determined to be "priority-to-second-subframe", the brightness is at first distributed preferentially to the white subframe which is the second subframe, the brightness is next distributed to the white subframe which is the first subframe, and then the brightness is distributed to the third to fifth subframes. The image display device according to the present modified example is obtained based on the image display device according to the fourth embodiment by displaying fixed color subframes in place of variable color subframes. According to the image display device of to the present modified example, the irregular flicker can be suppressed effectively in a field-sequential image display device having a plurality of fixed color subframes, by suitably determining an order of distributing the brightness of the pixel to the plurality of the fixed color subframes.

Fifth Embodiment

An image display device according to a fifth embodiment of the present invention has the same configuration as that of the image display device according to the first embodiment. The image display device according to the present embodiment is characterized in that with regard to each pixel and each neighboring pixel, the subframe data generator 12 makes the evaluation value larger as the distance between the pixel and the neighboring pixel is smaller.

Figure 16:
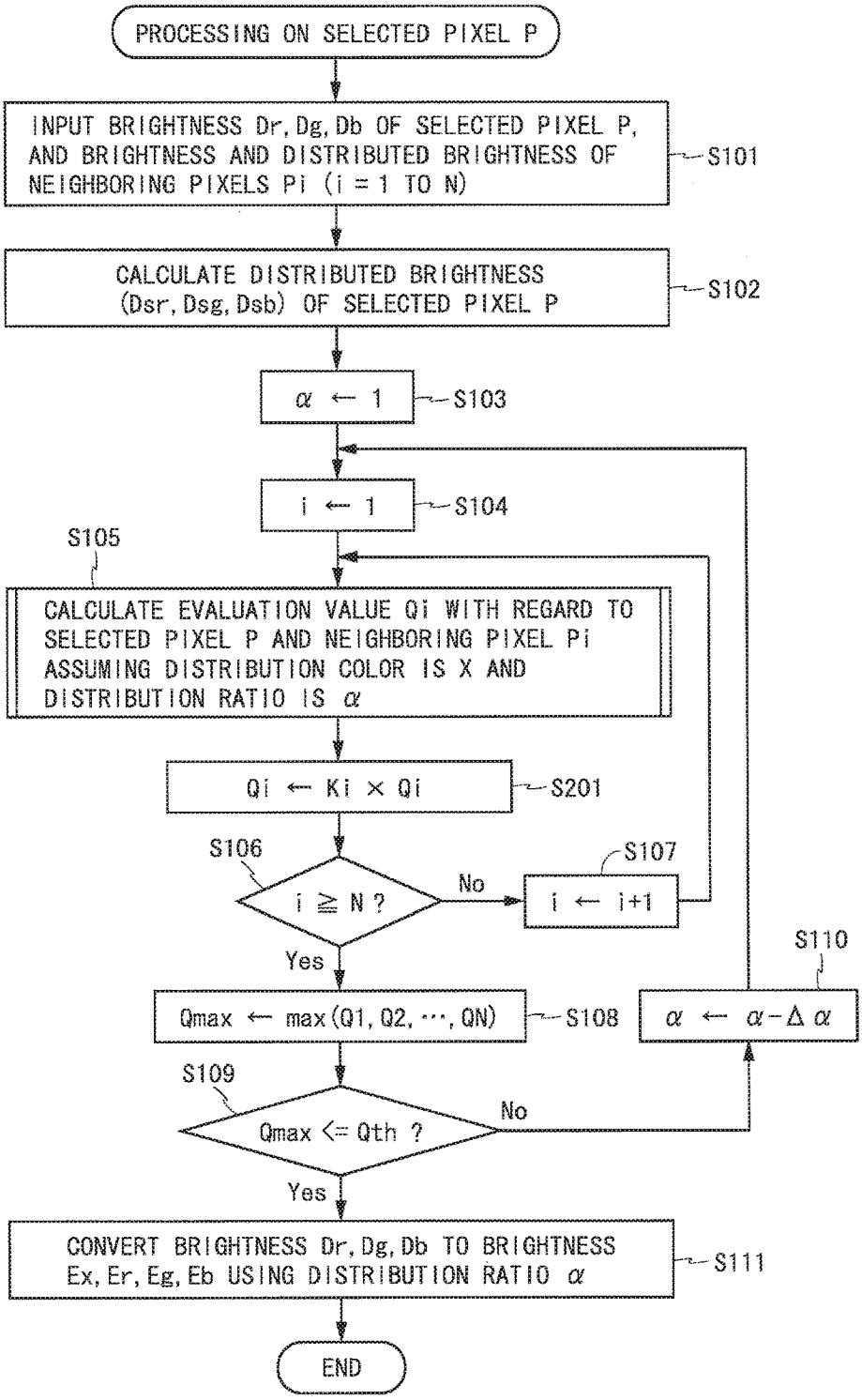
FIG. 16 is a flowchart showing processing performed on a selected pixel in an image display device according to a fifth embodiment of the present invention.
Figures 17, 18:
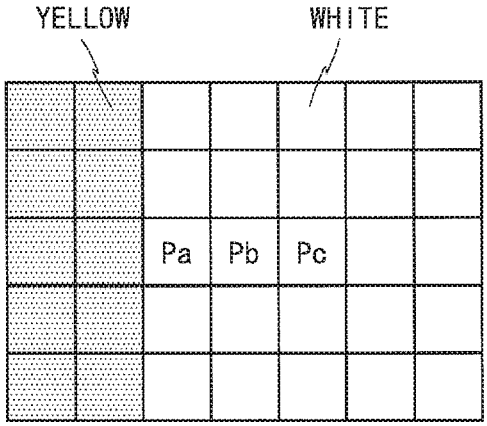
FIG. 17 is a diagram showing an example of coefficients in the image display device according to the fifth embodiment.
FIG. 18 is a diagram showing a state where a yellow display area and a white display area are adjacent to each other.

FIG. 16 is a flowchart showing processing performed on the selected pixel P by the subframe data generator 12 according to the present embodiment. The flowchart shown in FIG. 16 is obtained by adding step S201 after step S105 in the flowchart shown in FIG. 5. Step S201 is performed by the output brightness calculator 25. In step S201, the output brightness calculator 25 multiplies the evaluation value Qi calculated in step S105 by a coefficient Ki. The coefficient Ki is set to a larger value as the distance between the selected pixel P and the neighboring pixel Pi is smaller. FIG. 17 is a diagram showing an example of the coefficients Ki. In the example shown in FIG. 17, when Manhattan distances between the selected pixel P and the neighboring pixels Pi are 1 to 4 pixels, the coefficients Ki are 8, 4, 2, and 1, respectively.

The image display device according to the first embodiment performs the same calculation to all of the neighboring pixels when determining the distribution ratio $\alpha$.

For this reason, when pixel areas of different colors are adjacent to each other, the distribution ratio $\alpha$ may change greatly between pixels in the neighborhood of the boundary of the areas, thus causing deterioration in image quality of the display image. As an example, there is considered a case where a yellow display area and a white display area are adjacent to each other as shown in FIG. 18. In FIG. 18, a square represents a pixel.

In the image display device according to the first embodiment, neighboring pixels of a pixel Pa include pixels that display yellow and pixels that display white. Thus, to suppress the irregular flicker, the distribution ratio $\alpha$ of the pixel Pa is determined to be a value smaller than 1. This also applies to a pixel Pb. In contrast, since neighboring pixels of a pixel Pc only include pixels that display white, it is determined that no irregular flicker will occur and the distribution ratio $\alpha$ of the pixel Pc is determined to be 1. When the difference in the distribution ratio $\alpha$ between the pixel Pb and the pixel Pc is large, the image quality of the display image may deteriorate.

In the image display device according to the present embodiment, since the evaluation value Qi is multiplied by the coefficient Ki in step S201, the maximum value of the evaluation value Qi for the pixel Pb is smaller than the maximum value of the evaluation value Qi for the pixel Pa. Hence the distribution ratio of the pixel Pb is larger than the distribution ratio of the pixel Pa, and the distribution ratio $\alpha$ changes smoothly among the pixels Pa, Pb, Pc. Thus, according to the image display device of the present embodiment, it is possible to change the distribution ratio $\alpha$ spatially smoothly, and thus improve the image quality of the display image.

Figure 19:
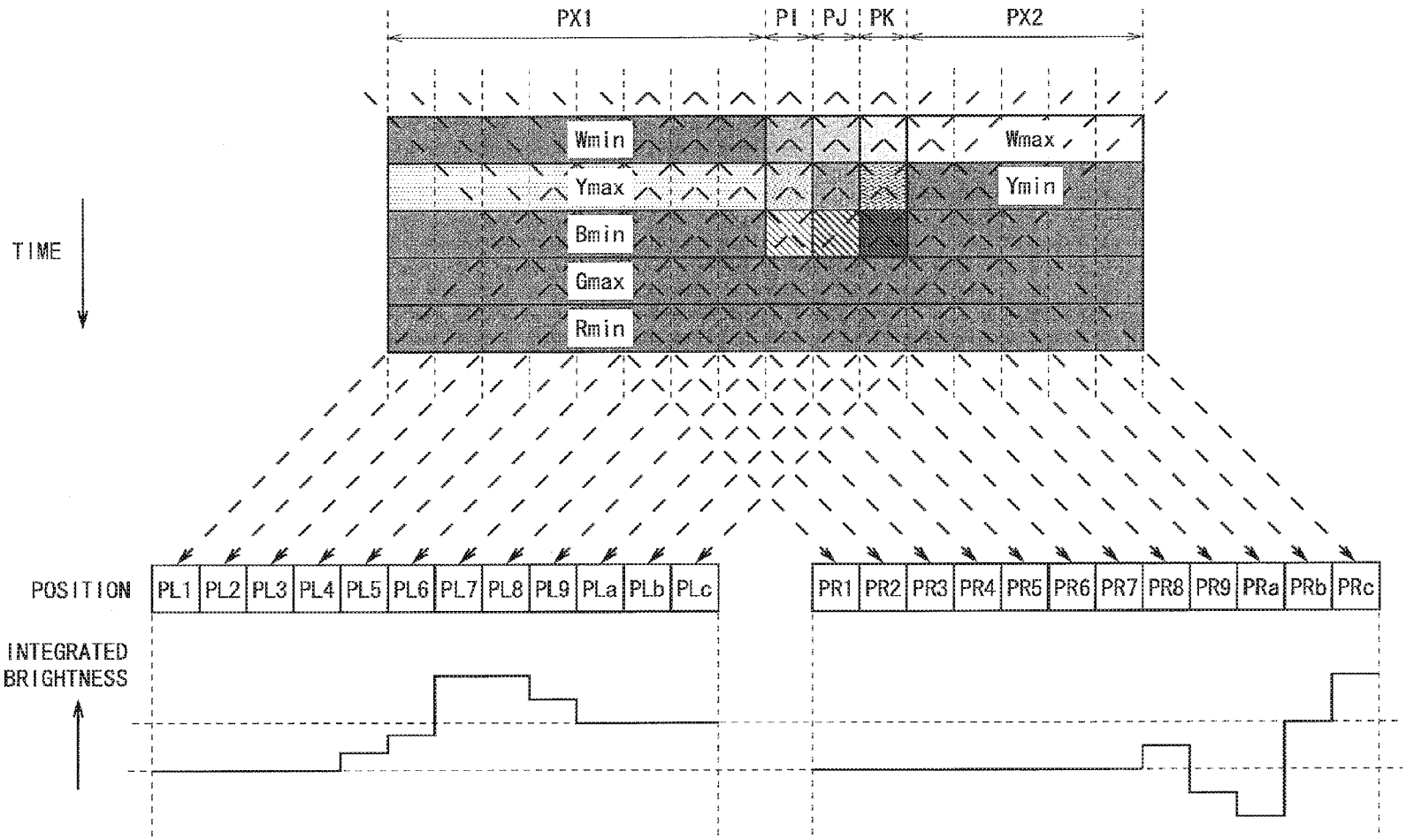
FIG. 19 is a diagram showing brightness of each subframe and integrated brightness in the image display device according to the fifth embodiment.

FIG. 19 is a diagram showing brightness of each subframe and integrated brightness in the image display device according to the present embodiment. It is assumed here that the image display device according to the present embodiment is an XXBGR system image display device, and that the distribution color of the first subframe is determined to be white and the distribution color of the second subframe is determined to be yellow, when an image in which a yellow display area and a white display area are adjacent to each other is to be displayed.

In FIG. 19, brightness of pixels within a range PX1 is the maximum value Ymax in the yellow subframe, and is zero (denoted by Wmin, Bmin, Gmin, Rmin in FIG. 19) in the other subframes. In the pixel within the range PX2, the distribution ratio α is the maximum value of 1. The brightness of the pixel within the range PX2 is the maximum value Wmax in the white subframe, and is zero (denoted by Ymin, Bmin, Gmin, Rmin in FIG. 19) in the other subframes. The distribution ratio α changes smoothly among pixels PI, PJ, PK, and a pixel right adjacent to the pixel PK. Specifically, the distribution ratio α increases sequentially in the order of the pixel PI, the pixel PJ, the pixel PK, and the pixel right adjacent to the pixel PK. The brightness of the pixels in the first subframe changes smoothly from Wmin to Wmax in the vicinity of the boundary of the pixel areas. The brightness of the pixels in the second subframe changes smoothly from Ymax to Ymin in the vicinity of the boundary of the pixel areas. The brightness of the pixels in the third subframe changes smoothly in the vicinity of the boundary of the pixel areas, and takes values other than zero at the pixel PI, the pixel PJ, and the pixel PK.

Only the yellow component is contained in integrated brightness at positions PL1 to PL4, PR1 to PR7. Only the white component is contained in brightness components at positions PLa to PLc, PRb. Since the distribution ratio α changes smoothly among the pixels PI, PJ, PK, and the pixel right adjacent to the pixel PK, the brightness component at each of the positions PL5 to PLc changes smoothly. This also applies to the integrated brightness at each of the positions PR8 to PRc. Therefore, both when the line of sight moves in the left direction and when the line of sight moves in the right direction, the brightness of the pixel changes smoothly between the yellow display area and the white display area. As thus described, according to the image display device of the present embodiment, it is possible to change the distribution ratio α spatially smoothly, and thus improve the image quality of the display image.

As for the image display device according to the present embodiment, it is possible to constitute the following modified examples. The coefficient Ki may be determined arbitrarily as long as it satisfies the condition that the coefficient Ki is larger as the distance between the selected pixel P and the neighboring pixel Pi is smaller. Further, in place of the loop processing shown in FIG. 16 (steps S104 to S110), the subframe data generator 12 may determine the distribution ratio α immediately based on the evaluation value Qi assuming that the distribution ratio α is a certain value. For example, the subframe data generator 12 may perform calculation shown in the following equation (3) based on N evaluation values Qi, to determine the distribution ratio α.

$$\alpha = T/\max(K1\times Q1, K2\times Q2, \ldots, KN\times QN) \quad (3)$$

In the equation (3), T represents a threshold which is determined in advance. Further, when max(K1×Q1,K2×Q2, . . . , KN×QN)≤Qth, α=1.

The subframe data generator subframe data generator 12 may determine the distribution ratio α using another calculation formula that makes the distribution ratio α smaller as the evaluation value Qi is larger. For example, the subframe data generator 12 may perform calculation shown in the following equation (4), to determine the distribution ratio α.

$$\alpha = T/\{(K1\times Q1 + K2\times Q2 + \ldots + KN\times QN)/N\} \quad (4)$$

Figure 20:
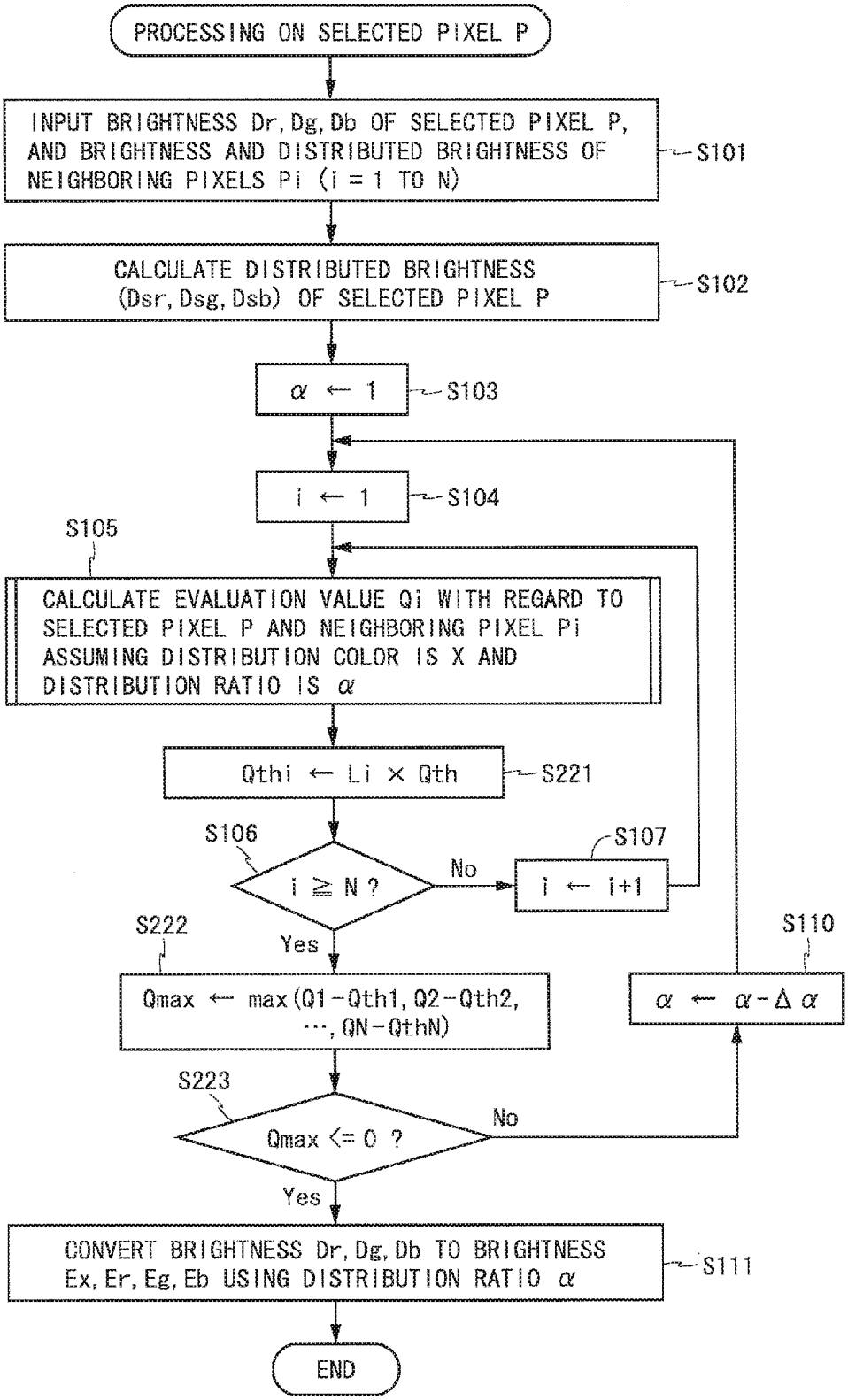
FIG. 20 is a flowchart showing processing performed on a selected pixel in an image display device according to a modified example of the fifth embodiment.

Further, instead of performing the processing of making the evaluation value Qi larger as the distance between the selected pixel P and the neighboring pixel Pi is smaller, the subframe data generator 12 may perform processing of making the threshold to be compared with the evaluation value Qi smaller as the distance between the selected pixel P and the neighboring pixel Pi is smaller. FIG. 20 is a flowchart showing processing performed on the selected pixel P by the subframe data generator 12 according to the present modified example. The flowchart shown in FIG. 20 is obtained by replacing steps S201, S108, and S109 respectively with steps S221, S222, and S223 in the flowchart shown in FIG. 16.

In step S221, the output brightness calculator 25 multiplies the threshold Qth by the coefficient Li, to calculate a threshold Qthi in accordance with the distance between the selected pixel P and the neighboring pixel Pi. The coefficient Li is set to a smaller value as the distance between the selected pixel P and the neighboring pixel Pi is smaller. In step S222, the output brightness calculator 25 calculates the maximum value Qmax of N values (Qi−Qthi). In step S223, the output brightness calculator 25 determines whether or not the maximum value Qmax calculated in step S222 is 0 or smaller. When No is determined in step S223, the output brightness calculator 25 goes to step S110, and when Yes is determined in step S223, the output brightness calculator 25 goes to step S111.

As thus described, the threshold Qthi to be compared with the evaluation value Qi is made smaller for the closer neighboring pixel, to have a larger effect on determination of the distribution ratio α, whereby it is possible to change the distribution ratio α spatially smoothly, and thus improve the image quality of the display image.

Sixth Embodiment

An image display device according to a sixth embodiment of the present invention has the same configuration as that of the image display device according to the first embodiment. The image display device according to the present embodiment is characterized in that with regard to each pixel, the subframe data generator 12 smooths the distribution ratio α determined based on the evaluation value, in a time axial direction, and distributes the brightness of the pixel to a plurality of subframes in accordance with the smoothed distribution ratio α.

Figure 21:
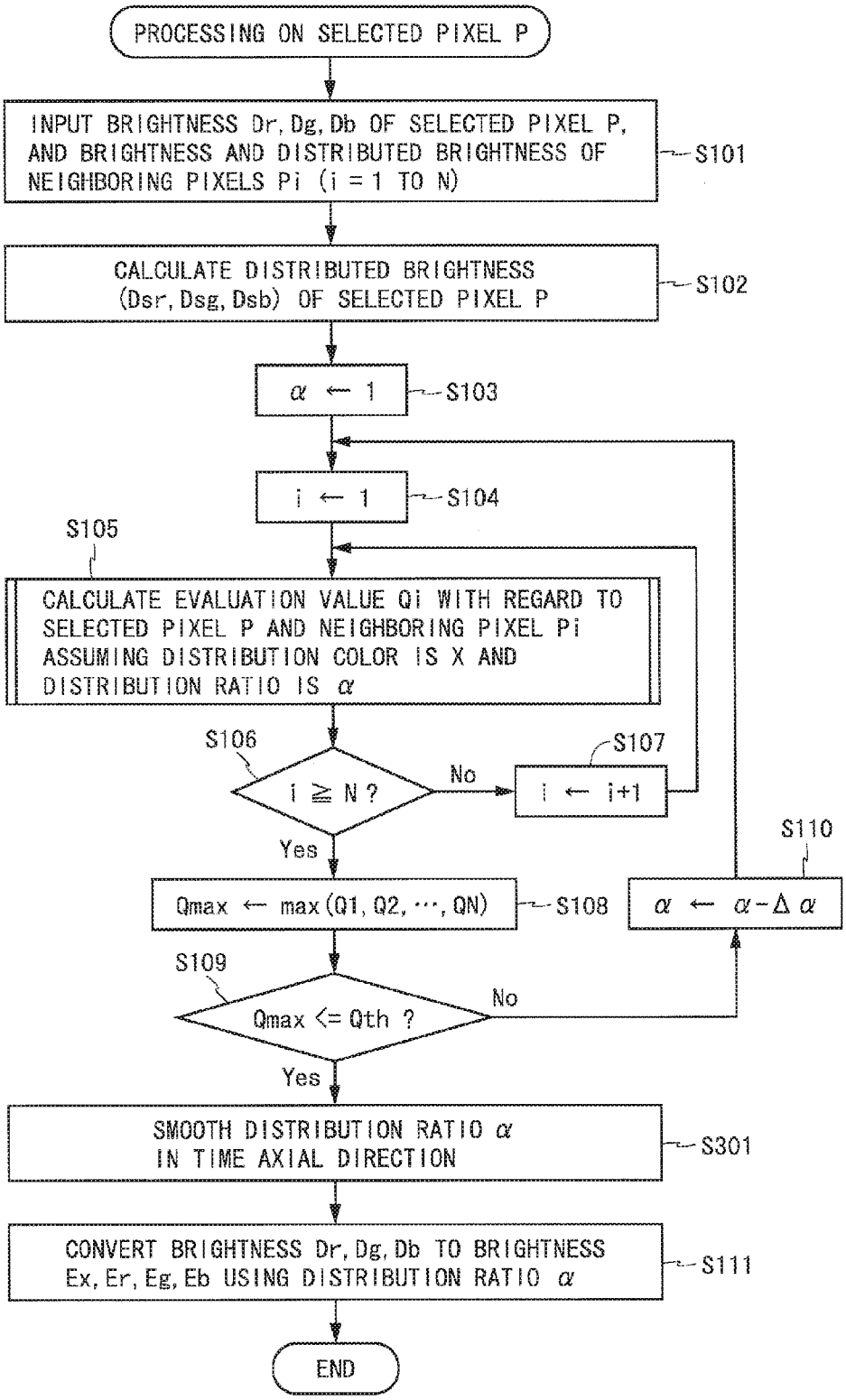
FIG. 21 is a flowchart showing processing performed on a selected pixel in an image display device according to a sixth embodiment of the present invention.

FIG. 21 is a flowchart showing processing performed on the selected pixel P by the subframe data generator 12 according to the present embodiment. The flowchart shown in FIG. 21 is obtained by adding step S301 before step S111 in the flowchart shown in FIG. 5. Step S301 is performed by the output brightness calculator 25. In step S301, the output brightness calculator 25 smooths the distribution ratio α calculated in the processing before step S301, in the time axial direction. Before step S301 is performed, the distribution ratio α determined with regard to the past frame is stored in the memory 27.

The output brightness calculator 25 may perform arbitrary smoothing processing in the time axial direction in step S301. For example, the output brightness calculator 25 may calculate a simple average or a weighted average of a distribution ratio of the current frame and a distribution ratio of the previous frame. Alternatively, the output brightness calculator 25 may calculate a simple average or a weighted average of the distribution ratio of the current frame and distribution ratios of a plurality of past frames. When the weighted average is calculated, a coefficient is preferably made larger for a frame closer to the current frame.

In an image display device in which step S301 is not performed, when a gradation difference is large between the previous frame and the current frame (e.g. in the case of a moving image), the distribution ratio α may change largely between the previous frame and the current frame to cause deterioration in image quality of the display image.

In the image display device according to the present embodiment, the subframe data generator 12 smooths the distribution ratio α determined based on the evaluation value, in the time axial direction. Thus, according to the image display device of the present embodiment, it is possible to change the distribution ratio α temporally smoothly, and thus improve the image quality of the display image.

As a modified example of the present embodiment, it is possible to constitute an image display device which smooths the distribution color X in the time axial direction, in addition to the distribution ratio α. In the image display device according to the present modified example, the subframe data generator 12 determines the distribution color X by smoothing, in the time axial direction, a color obtained based on the input brightness data. More specifically, the distribution color determinator 21 stores one or more distribution colors determined in the past, and determines the distribution color X to be a weighted average of the color obtained based on the input brightness data and one or more stored distribution colors. For example, when the distribution color determined for the previous frame is white and the color obtained based on the input brightness data is yellow, the distribution color determinator 21 determines the distribution color X for the current frame to be a color obtained by averaging white and yellow. According to the image display device of the present modified example, it is possible to change the distribution color temporally smoothly, and improve the image quality of the display image, by smoothing the distribution color in the time axial direction.

Seventh Embodiment

An image display device according to a seventh embodiment of the present invention has the same configuration as that of the image display device according to the first embodiment. The image display device according to the present embodiment is characterized in that the subframe data generator 12 has a plurality of methods for determining the distribution ratio α, and switches the method for determining the distribution ratio α in units of a pixel.

FIG. 22 is a diagram showing a distribution ratio determining method in an image display device according to the present embodiment. In FIG. 22, a square represents a pixel, and a character in the square represents a determination method for a distribution ratio to be applied to the pixel. In FIG. 22, the pixels are classified into two groups in a checkerboard pattern, and a first determination method (denoted by Ml) is applied to pixels in a first group while a second determination method (denoted by M2) is applied to pixels in a second group.

Figure 23:
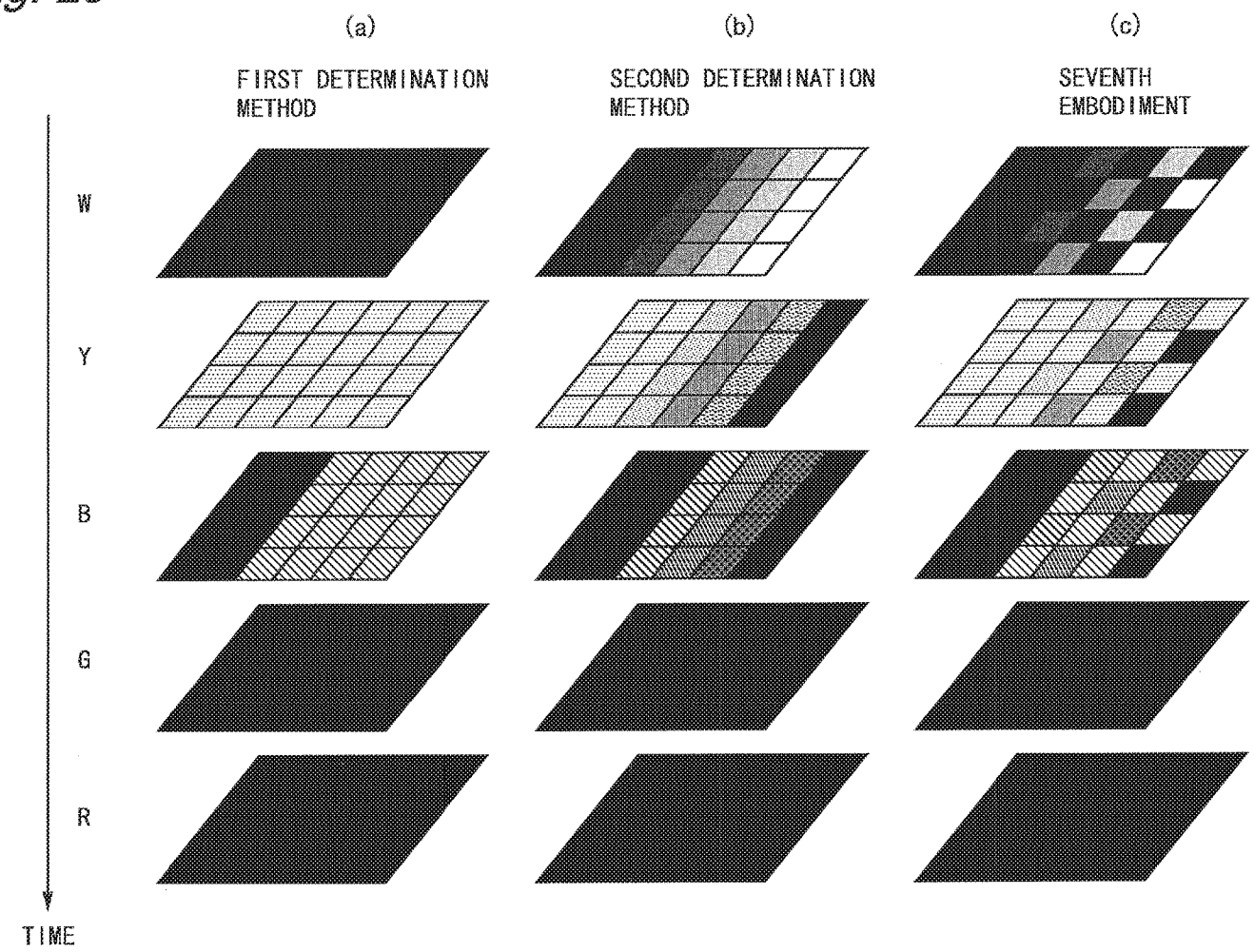
FIG. 23 is a diagram showing brightness of pixels of each subframe in the image display device according to the seventh embodiment.

Hereinafter, it is assumed that the image display device according to the present embodiment is an XXBGR system image display device, and that the distribution color X of the first subframe is determined to be white and the distribution X of the second subframe is determined to be yellow. FIG. 23 is a diagram showing brightness of pixels of each subframe in the image display device according to the present embodiment. In FIG. 23, it is assumed that eight pixels on the left side display yellow, and sixteen pixels on the right side display white. Here, the determining method of the distribution ratio according to the first embodiment is applied as a first determination method to the pixels in the first group, and the determining method of the distribution ratio according to the fifth embodiment is applied as a second determination method to the pixels in the second group.

If the first determination method is applied to all the pixels, the brightness of the pixels of each subframe is as shown in FIG. 23 (*a*). Further, if the second determination method is applied to all the pixels, the brightness of the pixels of each subframe is as shown in FIG. 23(*b*). In the image display device according to the present embodiment, the first determination method is applied to the pixels in the first group, and the second determination method is applied to the pixels in the second group. Hence in the image display device according to the present embodiment, the brightness of each subframe is as shown in FIG. 23(*c*).

In the image display device according to each of the first to sixth embodiments, even when the distribution ratio determining method according to each embodiment is applied, it is not possible to suppress the color breakup and the irregular flicker completely. Therefore, in the image display device according to the present embodiment, the subframe data generator 12 has a plurality of methods for determining the distribution ratio α, and switches the method for determining the distribution ratio α in units of a pixel. It is thereby possible to disperse within the display image the color breakup and the irregular flicker that cannot be suppressed only by applying one distribution ratio determining method, thus enabling improvement in image quality of the display image.

The image display device according to the present embodiment may switch the distribution ratio determining method in units of a pixel in an arbitrary manner. The image display device according to the present embodiment may switch the distribution ratio determining method to three or more kinds. The image display device according to the present embodiment may switch the distribution ratio determining method by the pixel at random, or may switch the method by the row of pixels or by the column of pixels. The image display device according to the present embodiment may classify pixels into a plurality of groups so as to form a specific shape (circular shape, elliptical shape, rhombic shape, and the like) and switch the distribution ratio determining method by the group.

Modified Examples of Each Embodiment

As for the image display devices according to the embodiments of the present invention, it is possible to constitute the following modified examples. The image display device of the present invention may determine a distribution ratio with regard to each color component of red, green, and blue individually. The present invention is also applicable to an image display device that switches and performs a plurality of systems of field-sequential drive. The present invention is also applicable to an image display device in which the number of color components contained in input video data is different from the number of subframes displayed in one frame period. The display order of subframes and a drive frequency (field rate) in the image display device of the present invention are arbitrary.

Other than the liquid crystal display device, the present invention is also applicable to a PDP (Plasma Display Panel), a MEMS (Micro Electro Mechanical Systems) display, and the like. The present invention is also applicable to an image display device that has a sub-pixel corresponding to each color component and drives a backlight in the field-sequential system. The present invention is also applicable to an image display device that controls brightness of a backlight (either brightness of a total plane or brightness of each area) in accordance with input video data and corrects the input video data accordingly. The present invention is also applicable not only to an image display device provided with a display panel and a backlight, but also to a light emission type image display device. The present invention is also applicable to a field-sequential image display device obtained by combining the above systems arbitrarily.

When brightness data is input from the outside, the image display device of the present invention may not be provided with the gradation/brightness conversion unit for performing inverse-gamma conversion. When the display has a linear characteristic, the image display device of the present invention may not be provided with the brightness/gradation conversion unit for performing gamma conversion. In place of the distributed brightness calculator, the image display device of the present invention may be provided with a distributed gradation calculation unit for calculating distributed gradation data representing gradation to be distributed to a plurality of subframes based on input gradation data. In this case, the gradation/brightness conversion unit may be provided in a post stage of the distributed gradation calculation unit. Input video data for each subframe subjected to frame interpolation for suppressing the color breakup when displaying a moving image may be input to the image display device of the present invention. In this case, the image display device of the present invention may perform processing on video data corresponding to the subframe to be displayed. Input video data subjected to frequency conversion by frame interpolation processing or the like may be input to the image display device of the present invention. Video data with lowered resolution, video data applied with a low-pass filter or the like, or some other data, may be input to the image display device of the present invention in place of raw data (original video data).

Further, the subframe data generator may not be provided with the stimulus value calculation unit when it is unnecessary for calculation of the evaluation value. In the image display device of the present invention, the format of video data input to the subframe data generator and the format of video data output from the subframe data generator may be arbitrary. In the image display device of the present invention, the range of neighboring pixels may be determined arbitrarily. For example, a pixel with a distance from the selected pixel (Euclidean distance or Manhattan distance) less than or equal to a predetermined distance may be used as the neighboring pixel. Alternatively, every pixel within the display image may be used as the neighboring pixel.

Further, by arbitrarily combining the features of the above-described image display devices unless contrary to the nature thereof, it is possible to constitute an image display device having a plurality of above-described features. For example, by combining any of the image display devices according to the fourth to seventh embodiments with the features of the second or third embodiment, it is possible to constitute an image display device which has the features of the fourth to seventh embodiments, and for which the color of the variable color subframe is selectable for each area.

INDUSTRIAL APPLICABILITY

The image display device of the present invention has the characteristic of suppressing irregular flicker that occurs in the vicinity of a boundary of pixel areas of different colors, and is thus usable for various kinds of field-sequential image display devices, such as a liquid crystal display device, a PDP, and the like.

DESCRIPTION OF REFERENCE CHARACTERS

1: PANEL DRIVE CIRCUIT
2: LIQUID CRYSTAL PANEL
3: BACKLIGHT DRIVE CIRCUIT
4: BACKLIGHT
10: IMAGE DISPLAY DEVICE
11: GRADATION/BRIGHTNESS CONVERSION UNIT
12: SUBFRAME DATA GENERATOR
13: BRIGHTNESS/GRADATION CONVERSION UNIT
14: CONVERSION TABLE
15: TIMING CONTROL UNIT
16: DISPLAY
21: DISTRIBUTION COLOR DETERMINATOR
22: DISTRIBUTED BRIGHTNESS CALCULATOR
23: INTEGRATED BRIGHTNESS CALCULATOR
24: STIMULUS VALUE CALCULATION UNIT
25: OUTPUT BRIGHTNESS CALCULATOR
26, 27: MEMORY
31: DISPLAY SCREEN
32: AREA

The invention claimed is:

1. A field-sequential image display device comprising:

a subframe data generator that generates output brightness data, the output brightness data corresponding to a plurality of subframes based on input brightness data, the input brightness data corresponding to a plurality of color components; and a display that displays the plurality of subframes, the plurality of subframes including a variable color subframe for which a color is selectable, during one frame period, according to a video signal based on the output brightness data, wherein the subframe data generator comprising:

a memory storing instructions, when executed by the subframe data generator, cause the subframe data generator to:

determine, based on the input brightness data, a distribution color which is the color of the variable color subframe, and generate the output brightness data for each pixel based on the input brightness data by:

determining a distribution ratio for each pixel based on:

a brightness of the pixel, brightnesses of neighboring pixels, and the distribution color, and distributing the brightness of the pixel to the plurality of subframes based on the distribution color and the distribution ratio.

2. The image display device according to claim 1, wherein after determining the distribution color, the subframe data generator, with regard to each pixel, is further caused to calculate an evaluation value related to a color difference when a line of sight moves, based on the brightness of the pixel, the brightnesses of the neighboring pixels and the distribution color, and the subframe data generator is further caused to determine the distribution ratio based on the evaluation value.

3. The image display device according to claim 2, wherein with regard to each pixel and each neighboring pixel, the subframe data generator is further caused to calculate two kinds of integrated brightnesses comprising integrated brightness when the line of sight moves and integrated brightness when the line of sight is fixed, and the subframe data generator is further caused to calculate the evaluation value based on variations in the two kinds of integrated brightnesses.

4. The image display device according to claim 3, wherein with regard to each pixel and each neighboring pixel, the subframe data generator is further caused to calculate, as the evaluation value, a ratio of the variation in the integrated brightness when the line of sight moves with respect to the variation in the integrated brightness when the line of sight is fixed.

5. The image display device according to claim 4, wherein the subframe data generator further caused to:

determine the distribution color based on the input brightness data;

calculate distributed brightness data, the brightness data representing brightness to be distributed to the plurality of subframes based on the input brightness data and the distribution color;

calculate the two kinds of integrated brightnesses based on the input brightness data, the distributed brightness data, and the distribution color; and generate the output brightness data by calculating the evaluation value based on the two kinds of integrated brightnesses, determining the distribution ratio based on the evaluation value, and distributing the brightness of the pixel contained in the input brightness data to the plurality of subframes based on the distribution color and the distribution ratio.

6. The image display device according to claim 2, wherein with regard to each pixel, the subframe data generator is further caused to determine the distribution ratio such that a maximum value of the evaluation values is less than or equal to a threshold.

7. The image display device according to claim 6, wherein the subframe data generator is further caused to determine the distribution ratio with regard to each pixel by setting the distribution ratio to the maximum value at first, and decreasing the distribution ratio in steps until the maximum value of the evaluation value is less than or equal to the threshold.

8. The image display device according to claim 1, wherein the display switches the color of the variable color subframe for an entire display screen, and the subframe data generator is further caused to determine one distribution color for the entire display screen based on the input brightness data.

9. The image display device according to claim 1, wherein the display has a function of dividing a display screen into a plurality of areas and switching the color of the variable color subframe for each area, and the subframe data generator is further caused to determine the distribution color for each area based on the input brightness data.

10. The image display device according to claim 1, wherein the display displays a plurality of variable color subframes in one frame period, and the subframe data generator is further caused to determine an order for distributing the brightness of the pixel to the plurality of the variable color subframes, and distribute the brightness of the pixel to the plurality of the subframes based on the distribution color, the order, and the distribution ratio.

11. The image display device according to claim 2, wherein with regard to each pixel and each neighboring pixel, the subframe data generator is further caused to make the evaluation value larger as a distance between the pixel and the neighboring pixel is smaller.

12. The image display device according to claim 2, wherein with regard to each pixel and each neighboring pixel, the subframe data generator is further caused to make a value to be compared with the evaluation value smaller as a distance between the pixel and the neighboring pixel is smaller.

13. The image display device according to claim 2, wherein with regard to each pixel, the subframe data generator is further caused to smooth the distribution ratio determined based on the evaluation value in a time axial direction, and distribute the brightness of the pixel to the plurality of subframes based on the distribution color and the smoothed distribution ratio.

14. The image display device according to claim 13, wherein the subframe data generator is further caused to determine the distribution color by smoothing a color obtained based on the input brightness data, in a time axial direction.

15. The image display device according to claim 1, wherein the subframe data generator has a plurality of methods for determining the distribution ratio, and is further caused to switch the methods for determining the distribution ratio in units of a pixel.

16. A field-sequential image display method comprising:

a step of generating output brightness data corresponding to a plurality of subframes based on input brightness data, the input brightness data corresponding to a plurality of color components; and a step of displaying the plurality of subframes including a variable color subframe for which a color is selectable, in one frame period, in accordance with a video signal based on the output brightness data, wherein in the step of generating, a distribution color which is the color of the variable color subframe is determined based on the input brightness data, and the output brightness data is generated with regard to each pixel based on the input brightness data by determining a distribution ratio for each pixel based on a brightness of the pixel, brightnesses of neighboring pixels, and the distribution color, and by distributing the brightness of the pixel to the plurality of subframes based on the distribution color and the distribution ratio.

17. A field-sequential image display device comprising:

a subframe data generator that generates output brightness data, the output brightness data corresponding to a plurality of subframes based on input brightness data, the input brightness data corresponding to a plurality of color components; and a display that displays a plurality of fixed color subframes, during one frame period, according to a video signal based on the output brightness data, wherein the subframe data generator comprising:

a memory storing instructions, when executed by the subframe data generator, causes the subframe data generator to:

determine an order for distributing brightness of a pixel to the plurality of the fixed color subframes, and generate the output brightness data for each pixel based on the input brightness data by:

determining a distribution ratio for each pixel based on:

a brightness of the pixel and brightnesses of neighboring pixels, and distributing the brightness of the pixel to the plurality of subframes based on the order and the distribution ratio.

* * * * *